US009411274B2

(12) United States Patent
Kadowaki et al.

(10) Patent No.: US 9,411,274 B2
(45) Date of Patent: Aug. 9, 2016

(54) IMAGE FORMING APPARATUS SWITCHING BETWEEN FIRST AND SECOND AIR FEEDING OPERATIONS WITH DIFFERENT OPENING AMOUNTS OF AN OPENING THROUGH WHICH AIR FED FROM A FAN PASSES ACCORDING TO THE DETECTED TEMPERATURE

(71) Applicant: CANON KABUSHIKI KAISHA, Tokyo (JP)

(72) Inventors: Hiroyuki Kadowaki, Yokohama (JP); Toshiya Kaino, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/796,555

(22) Filed: Jul. 10, 2015

(65) Prior Publication Data

US 2015/0309454 A1 Oct. 29, 2015

Related U.S. Application Data

(62) Division of application No. 14/260,904, filed on Apr. 24, 2014, now Pat. No. 9,116,480.

(30) Foreign Application Priority Data

Apr. 26, 2013 (JP) ..... 2013-093609
Mar. 24, 2014 (JP) ..... 2014-060012

(51) Int. Cl.
*G03G 15/20* (2006.01)

(52) U.S. Cl.
CPC ..... *G03G 15/2017* (2013.01); *G03G 15/2042* (2013.01); *G03G 2215/2035* (2013.01)

(58) Field of Classification Search
CPC ..... G03G 15/2017; G03G 15/2021; G03G 15/2039; G03G 15/2046; G03G 15/2053; G03G 15/2014; G03G 2215/2035
USPC ..... 399/69, 92
See application file for complete search history.

(56) References Cited

U.S. PATENT DOCUMENTS

| | | | |
|---|---|---|---|
| 7,251,447 | B2 | 7/2007 | Kanamori et al. |
| 7,536,145 | B2 | 5/2009 | Tomine et al. |
| 8,554,098 | B2 | 10/2013 | Nishiyama |
| 8,755,706 | B2 | 6/2014 | Minagawa et al. |
| 8,855,516 | B2 | 10/2014 | Koyama et al. |
| 8,909,088 | B2 | 12/2014 | Murooka |
| 9,116,480 | B2 * | 8/2015 | Kadowaki et al. . G03G 15/2017 |

FOREIGN PATENT DOCUMENTS

| | | | |
|---|---|---|---|
| JP | 60-136779 | A | 7/1985 |
| JP | 2001-183929 | A | 7/2001 |
| JP | 2004-198895 | A | 7/2004 |
| JP | 2007-187816 | A | 7/2007 |

* cited by examiner

*Primary Examiner* — William J Royer
(74) *Attorney, Agent, or Firm* — Fitzpatrick, Cella, Harper & Scinto

(57) ABSTRACT

An image forming apparatus includes a fixing portion, including: a heating member and a back-up member forming a nip; and an air feeding portion for feeding air to a non-sheet-passing area of at least one of the heating member and the back-up member, the air feeding portion including a fan for feeding the air, a duct, including an opening, for guiding the air fed from the fan through the opening to the non-sheet-passing area, and an adjusting member for adjusting an opening amount of the opening. The apparatus executes a first air feeding operation with a first opening amount and a first rotational frequency of the fan and a second air feeding operation with a second opening amount and a second rotational frequency, when the fixing portion fixes the images on sheets having the same widths.

15 Claims, 12 Drawing Sheets

(a)

(b)

(a)

(b)

| SHEET WIDTH | P.S(mm/s) | INTERVAL(mm) | OPENING(mm) | TARGET(°C) |
|---|---|---|---|---|
| A4(LANDSCAPE)(297mm) | 190 | 36.5 | 4 | 180 |
| LTR(LANDSCAPE)(279.4mm) | 190 | 36.5 | 4 | 180 |
| A4(PORTRAIT)(210mm) | 143 | 83 | 32 | 168 |
| A5PORTRAIT(148mm) | 143 | 107 | 62 | 168 |
| NARROWER THAN 148mm | 143 | 107-370 | 0 | 168 |

IMAGE FORMING APPARATUS SWITCHING BETWEEN FIRST AND SECOND AIR FEEDING OPERATIONS WITH DIFFERENT OPENING AMOUNTS OF AN OPENING THROUGH WHICH AIR FED FROM A FAN PASSES ACCORDING TO THE DETECTED TEMPERATURE

This application is a division of application Ser. No. 14/260,904, filed Apr. 24, 2014.

FIELD OF THE INVENTION AND RELATED ART

The present invention relates to image forming apparatuses such as electrophotographic copying machines, electrophotographic printers, and the like.

It has been a common practice for an image forming apparatus such as a copying machine, a laser beam printer, and the like to be equipped with a fixing device. One of the heating methods employed by a fixing device is the so-called film heating method, which is excellent in that it enables an image forming apparatus to start up virtually instantly. An image heating apparatus of the so-called film heating type comprises a heater, a heat resistant film (fixing member), a pressure roller (pressure applying member), and a heater. The pressure roller is pressed against the heater, with the placement of the heat resistant film between itself and heater. Thus, a pressure nip is formed between the heater and film. In operation, a sheet of a recording medium is conveyed through the pressure nip, while remaining pinched between the film and pressure rollers. Consequently, the unfixed toner image on the sheet of recording medium is thermally fixed to the sheet (Patent Document 1).

In a case where a substantial number of sheets of a recording medium, the dimension of which, in the direction perpendicular to the recording medium conveyance direction, is less than that of the heat generating area of the heater, are continuously conveyed through the fixing device, the heat thereof is given to the portion of the fixation nip corresponding in position to the sheet path, and is given to the sheets of the recording medium, which are then conveyed out of the fixation nip. On the other hand, the heat given to the portions of the fixation nip outside the sheet path (out-of-sheet-path portions of fixation nip) accumulates in the structural components, such as the fixing member, the pressing member, and the like, of the fixing device. Therefore, the out-of-sheet-path portions of the fixation nip are likely to unwantedly increase in temperature.

There is disclosed in Japanese Laid-open patent application 2004-198895, a fixing apparatus structured so that the revolution of its cooling fan is controlled to keep its out-of-sheet-path portions lower in temperature than a preset tolerable level.

However, there is a limit to the speed-revolution range in which the cooling fan can be varied. Therefore, it is sometimes impossible to set the revolution speed of the cooling fan to a proper value for dealing with the problem that the out-of-sheet-path portions of the fixation nip of a fixing device unwantedly increase in temperature. For example, there occurs sometimes a situation in which the values in the abovementioned fan-revolution speed range are too small to deal with the unwanted temperature increase of the out-of-sheet path portions of the fixation nip, because the temperature increase is moderate, and therefore, fixation failure occurs. There also occurs sometimes a situation in which the values in the abovementioned fan revolution speed range is too small to deal with the unwanted temperature increase of the out-of-sheet-path portions of the fixation nip, because the temperature increase is too severe, and therefore, the so-called "hot offset" occurs.

SUMMARY OF THE INVENTION

According to an aspect of the present invention, there is provided an image forming apparatus for forming a toner image on a recording material. The image forming apparatus comprises: an image forming station for forming an unfixed toner image on the recording material; a fixing portion, including a heating member and a back-up member for cooperating with the heating member to form a nip, for fixing the unfixed toner image on the recording material by heating the recording material having the formed unfixed toner image in the nip while feeding the recording material; and an air feeding portion for feeding air to a non-sheet-passing area of at least one of the heating member and the back-up member. The air feeding portion includes a fan for feeding the air, a duct, including an opening, for guiding the air fed from the fan through the opening to the non-sheet-passing area, and an adjusting member for adjusting an opening amount of the opening. The apparatus is capable of executing a first air feeding operation with a first opening amount and a first rotational frequency of the fan and a second air feeding operation with a second opening amount different from the first opening amount and a second rotational frequency different from the first rotational frequency, when the fixing portion fixes the images on recording materials having the same widths measured in a direction perpendicular to a feeding direction of the recording materials.

According to another aspect of the present invention, there is provided an image forming apparatus for forming a toner image on a recording material. The image forming apparatus comprises: an image forming station for forming an unfixed toner image on the recording material; a fixing portion, including a heating member and a back-up member for cooperating with the heating member to form a nip, for fixing the unfixed toner image on the recording material by heating the recording material having the formed unfixed toner image in the nip while feeding the recording material; and an air feeding portion for feeding air to a non-sheet-passing area of at least one of the heating member and the back-up member. The air feeding portion includes a fan for feeding the air, a duct, including an opening, for guiding the air fed from the fan through the opening to the non-sheet-passing area, and an adjusting member for adjusting an opening amount of the opening. The apparatus is capable of executing a first air feeding operation with a first opening amount and a first rotational frequency of the fan when a temperature of the non-sheet-passing area is lower than a threshold temperature, and is capable of executing a second air feeding operation with a second opening amount different from the first opening amount and a second rotational frequency different from the first rotational frequency when the temperature of the non-sheet-passing area is higher than the threshold temperature.

According to a further aspect of the present invention, there is provided an image forming apparatus for forming a toner image on a recording material. The image forming apparatus comprises: an image forming station for forming an unfixed toner image on the recording material; a fixing portion, including a heating member and a back-up member for cooperating with the heating member to form a nip, for fixing the unfixed toner image on the recording material by heating the recording material having the formed unfixed toner image in the nip while feeding the recording material; and an air feeding portion for feeding air to a non-sheet-passing area of at least one of the heating member and the back-up member. The member, said air feeding portion includes including a fan for feeding the air, a duct, including an opening, for guiding the air fed from the fan through the opening to the non-sheet-passing area, and an adjusting member for adjusting an opening amount of the opening. The apparatus is capable of executing, in accordance with a temperature of the non-sheet-passing area, a first air feeding operation with a first opening amount and a first rotational frequency of the fan and a second air feeding operation with a second opening amount different from the first opening amount and a second rotational frequency different from the first rotational frequency.

Further features of the present invention will become apparent from the following description of exemplary embodiments with reference to the attached drawings.

DESCRIPTION OF THE PREFERRED EMBODIMENTS

First Embodiment

Hereinafter, some of the preferred embodiments of the present invention are described with reference to the appended drawings.

(Image Forming Apparatus)

Figure 2:
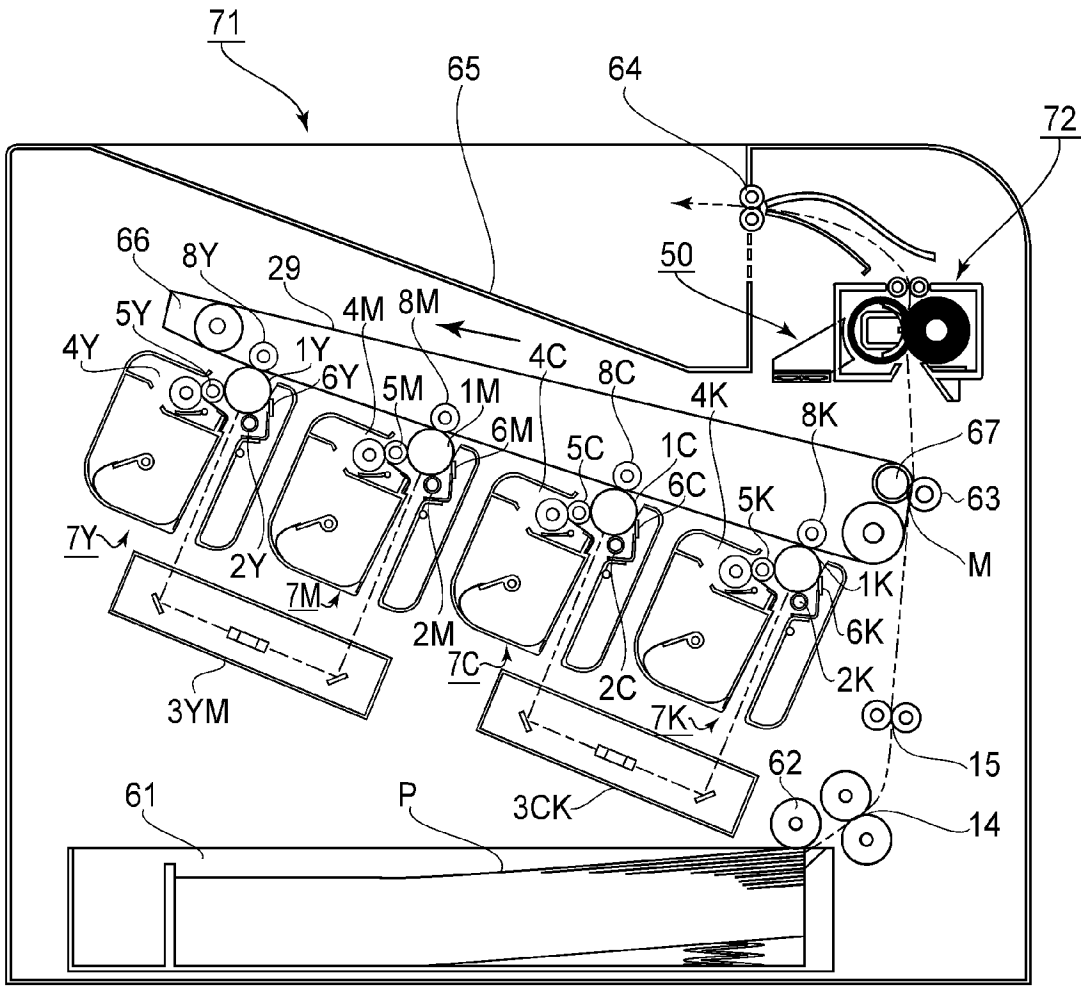
FIG. 2 is a schematic sectional view of the image forming apparatus having the fixing device in the first embodiment of the present invention.

Referring to FIG. 2, the general structure of an image forming apparatus in this embodiment is shown. FIG. 2 is a schematic sectional view of a full color laser printer (which hereafter will be referred to simply as printer 71), which is an example of a typical image forming apparatus to which the present invention is applicable. The image forming apparatus in this embodiment of the present invention is a full-color laser printer equipped with multiple photosensitive drums. However, this embodiment is not intended to limit the present invention in scope. That is, the present invention is also applicable to monochromatic copying machines, monochromatic printers, and the like which are equipped with only a single photosensitive drum.

There is disposed in the bottom portion of the printer 71, a cassette 61 which can be pulled out of the main assembly of the printer 71. Sheets P of a recording medium stored in layers in the cassette 61 are fed by a pickup roller 62 into the main assembly of the printer 71, are separated by a pair of feeding/retarding rollers 14, and are conveyed one by one to a pair of registration rollers 15.

The printer 71 is provided with multiple image forming portions 7 as image forming means, more specifically, image forming stations 7Y, 7M, 7C and 7K (which hereinafter will be referred to as image forming portions 7) which correspond to yellow, magenta, cyan and black color components, respectively. The image forming portions 7 are aligned in parallel in the direction in which the recording medium is conveyed. The image forming stations 7Y, 7M, 7C and 7K have: photosensitive drums 1Y, 1M, 1C and 1K, respectively, which are image bearing members (which hereafter may be referred to simply as the photosensitive drums 1); charging devices 2Y, 2M, 2C and 2K which uniformly charge the photosensitive drums 1, respectively; and developing devices 4Y, 4M, 4C and 4K, respectively. The developing devices 4Y, 4M, 4C and 4K contain development rollers 5Y, 5M, 5C and 5K, respectively, which adhere toner to an electrostatic latent image on the photosensitive drums 1 to develop the electrostatic latent image into a visible image, that is, an image formed of toner (which hereafter will be referred to as a toner image).

Further, the printer 71 is provided with primary transferring portions 8Y, 8M, 8C and 8K (which hereafter will be referred to simply as primary transferring portion 8 regardless of color components to which they are related), which transfer the toner image on the photosensitive drums 1 onto an intermediary transfer belt 29. It is also provided with cleaning blades 6Y, 6M, 6C and 6K which remove the toner which failed to be transferred in the primary transferring portions 8, and therefore, remains on the photosensitive drums 1, from the photosensitive drums 1. There are also provided on the bottom side of the image forming portions 7, scanner units 3YM, and 3CK, which project a beam of laser light, while modulating the beam according to the information of the image to be formed, in order to form an electrostatic latent image on the photosensitive drums 1.

After a toner image is transferred onto the intermediary transfer belt 29 in the primary transferring portion 8, it is transferred onto a sheet P of recording medium, in a secondary transferring portion M formed by a belt-backing roller 67 and a secondary transfer roller 63. The secondary transfer residual toner, which is the toner which failed to be transferred onto a sheet P of the recording medium in the secondary transferring portion M, and therefore, remains on the intermediary transfer belt 29 after the secondary transfer, is removed from the intermediary transfer belt 29, and recovered, by a belt cleaning device 66. After being conveyed through the secondary transferring portion M, the sheet P of the recording medium is conveyed through an image fixing device 72, in which the unfixed toner image on the sheet P is fixed to the sheet P. After the fixation of the toner image to the sheet P, the sheet P is conveyed further to a pair of discharge rollers 64, by which it is discharged into a delivery tray 65 to be stacked in the delivery tray 65.

Regarding the width of the recording medium passage of the printer 71 in this embodiment, the dimensions of the smallest (narrowest) and largest (widest) sheets P of the recording medium, in terms of the direction perpendicular to the recording medium conveyance direction, which are usable with the printer 71, are 105 mm and 297 mm, respectively. Further, the printing speed of the printer 71 is 45 sheets (size A4; in portrait orientation)/min.

Next, referring to FIGS. 3-6, the fixing device 72 is described. The fixing device 72 has: a heater 30 as a heating member; a pressure roller 20; a fixation sleeve 10, which is a cylindrical and rotational heating member; a heater holder 41; a pressure bearing stay 42; and a pressure applying means 43. It is structured so that the pressure roller 20 is rotationally driven to rotationally (circularly) move the fixation sleeve 10 by the rotation of the pressure roller 20, and also, so that a toner image T on the sheet P is heated by the fixation sleeve 10, which is heated by the heater 30.

Further, the fixing device 72 is provided with a pair of fixation flanges 45 as regulating members, which regulate the lateral deviation of the fixation sleeve 10, by remaining in contact with the edges of the fixation sleeve 10, one for one. The heater 30, the fixation sleeve 10, the heater holder 41, the pressure bearing stay 42, and the pressure roller 20 are all long and narrow members, which are disposed so that their lengthwise direction becomes perpendicular to the recording medium conveyance direction.

Figure 5:
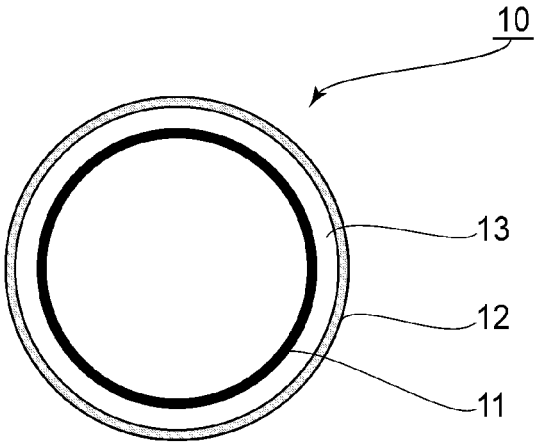
FIG. 5 is a schematic sectional view of the fixation sleeve of the fixing device in the first embodiment of the present invention.

Referring to FIG. 5, the fixation sleeve 10, which is a rotational heating member, has a substrative layer 11 and a parting layer 12. The substrative layer 11 is an endless member formed of a heat resistant and flexible substance. The parting layer 12 covers the outward surface of the substrative layer 11. In order to improve the fixation performance and image quality produced by the fixation sleeve 10, the fixation sleeve 10 may be provided with an elastic layer 13, which is to be placed between the outward surface of the substrative layer 11 and the inward surface of the elastic layer 13.

The material for the substrative layer 11 is desired to be a metallic substance such as SUS, Ni, or the like, which is high in thermal conductivity. Instead of an endless belt formed of a metallic substance, a thin and flexible endless belt formed of heat resistant resin such as polyimide, polyamide-imide, PEEK, or the like, may be used as the substrative layer 11. The outward surface of the substrative layer 11 is coated with one, or blend, of PFA, PTFE, FEP, and the like fluorinated resins, or covered with a piece of tube made of one of the preceding fluorinated resins. PFA, PTFE and FEP are abbreviations of perfluoroalcoxyl resin, polytetra-fluoroethylene resin, tetrafluoroethylene-hexafluoro-propyrene resin, respectively.

In consideration of durability, the thickness of the parting layer 12 needs to be no less than 5 μm. Further, the thicker the parting layer 12, the lower the thermal conductivity of the parting layer 12. In other words, the thickness of the parting layer 12 affects the fixation performance of the fixing device 72. Therefore, the thickness of the parting layer 12 has to be no more than 50 μm. In this embodiment, therefore, the thickness of the parting layer 12 is set to be no less than 5 μm and no more than 50 μm, in order to make the image-fixing performance of the parting layer 12 satisfactory, without sacrificing the durability of the parting layer 12.

Further, placing the elastic layer 13 between the outward surface of the substrative layer 11 and the inward surface of the parting layer 12 makes it possible to wrap the unfixed toner image T on a sheet P of the recording medium from all sides, and therefore, can uniformly heat the toner image T. Therefore, it can make the fixation sleeve 10 conform to the microscopic peaks and valleys of the sheet P of the recording medium and the toner image T thereon. Therefore, it can prevent the problem that as a halftone image or the like is fixed, it becomes rough in texture. In other words, it can make the fixing device 72 satisfactorily (uniformly) fix a toner image T. The thicker the elastic layer 13, the better the manner in which the fixation sleeve 10 wraps the toner image T borne by the sheet P of the recording medium, and the more uniformly the fixation sleeve 10 can thermally fix the toner image T to the sheet P. That is, the thicker the elastic layer 13, the better the effectiveness with which the fixation sleeve 10 can wrap the unfixed toner image T.

The thickness of the elastic layer 13 is directly related to the thermal capacity of the fixation sleeve 10. That is, the thicker the elastic layer 13, the greater the thermal capacity of the elastic layer 13 (fixation sleeve 10), and therefore, the longer it takes for the temperature of the elastic layer 13 (fixation sleeve 10) to reach the temperature level which is high enough to properly fix a toner image T on a sheet P of the recording medium to the sheet P. That is, if the elastic layer 13 is excessively thick, it takes too much time for the temperature of the fixation sleeve 10 to reach a temperature level which is high enough to properly fix a toner image T. In other words, it nullifies the very characteristic of a fixing device of the so-called film heating type, that is, the characteristic that it can virtually instantly start up. Therefore, the thickness of the elastic layer 13 is made to be no less than 50 μm and not more than 500 μm. In terms of the thermal conductivity of the elastic layer 13, the higher the better; the elastic layer 13 is desired to be no less than 0.5 W/m·K in thermal capacity. In order to provide the elastic layer 13 with such thermal conductivity, ZnO, $Al_2O_3$, SiC, metallic silicon, or the like, thermally conductive filler is mixed into silicone rubber to adjust the thermal conductivity of the silicone rubber.

The external diameter of the fixation sleeve 10 is directly related to the thermal capacity of the fixation sleeve 10. Therefore, from the standpoint of minimizing the thermal capacity of the fixation sleeve 10, the external diameter of the fixation sleeve 10 is desired to be as small as possible. However, reducing the external diameter of the fixation sleeve 10 reduces a nip N in dimension in terms of the recording medium conveyance direction. Therefore, it is not allowed to make the external diameter of the fixation sleeve 10 excessively small. In this embodiment, therefore, in consideration of the speed (process speed) of the image forming apparatus or the like factors, SUS is used as the material for the substrative layer 11, and the thickness and internal diameter of the substrative layer 11 are made to be 30 μm and 24 mm, respectively.

As for the material for the elastic layer 13, silicone rubber, which is 1.3 W/(m·K) in thermal capacity, is used. The thickness of the elastic layer 13 is made to be 275 μm. Further, for the material for the parting layer 12, a piece of PFA tube was used. The thickness of the parting layer 12 is 20 μm.

The heater holder 41 is formed of a heat resistant resin such as liquid polymer, phenol resin, PPS, PEEK, or the like. It is in the form of a trough, which is semicircular in cross-section. In terms of the thermal efficiency with which the heater 30 can heat the inward surface of the fixation sleeve 10, the lower the heater holder 41 in thermal conductivity, the higher the thermal efficiency. Therefore, hollow filler, such as glass balloons, silica balloons, or the like may be dispersed in the heat resistant resin used as the material for the heater holder 41. The bottom surface (which faces pressure roller 20) of the heater holder 41 is provided with a groove, which is U-shaped in cross-section and extends in the lengthwise direction of the heater holder 41.

The heater 30 is held by the heater holder 41, by a substrative layer 31 in such a manner that the substrative layer 31 of the heater 30 fits in the above-described groove of the heater holder 41, whereas a friction-reducing protective layer 34 (which will be described later) of the heater 30 is exposed from the groove of the heater holder 41. The fixation sleeve 10 is loosely fitted around the heater holder 41, which is held by its unshown lengthwise ends, by an apparatus frame 27.

Figure 3:
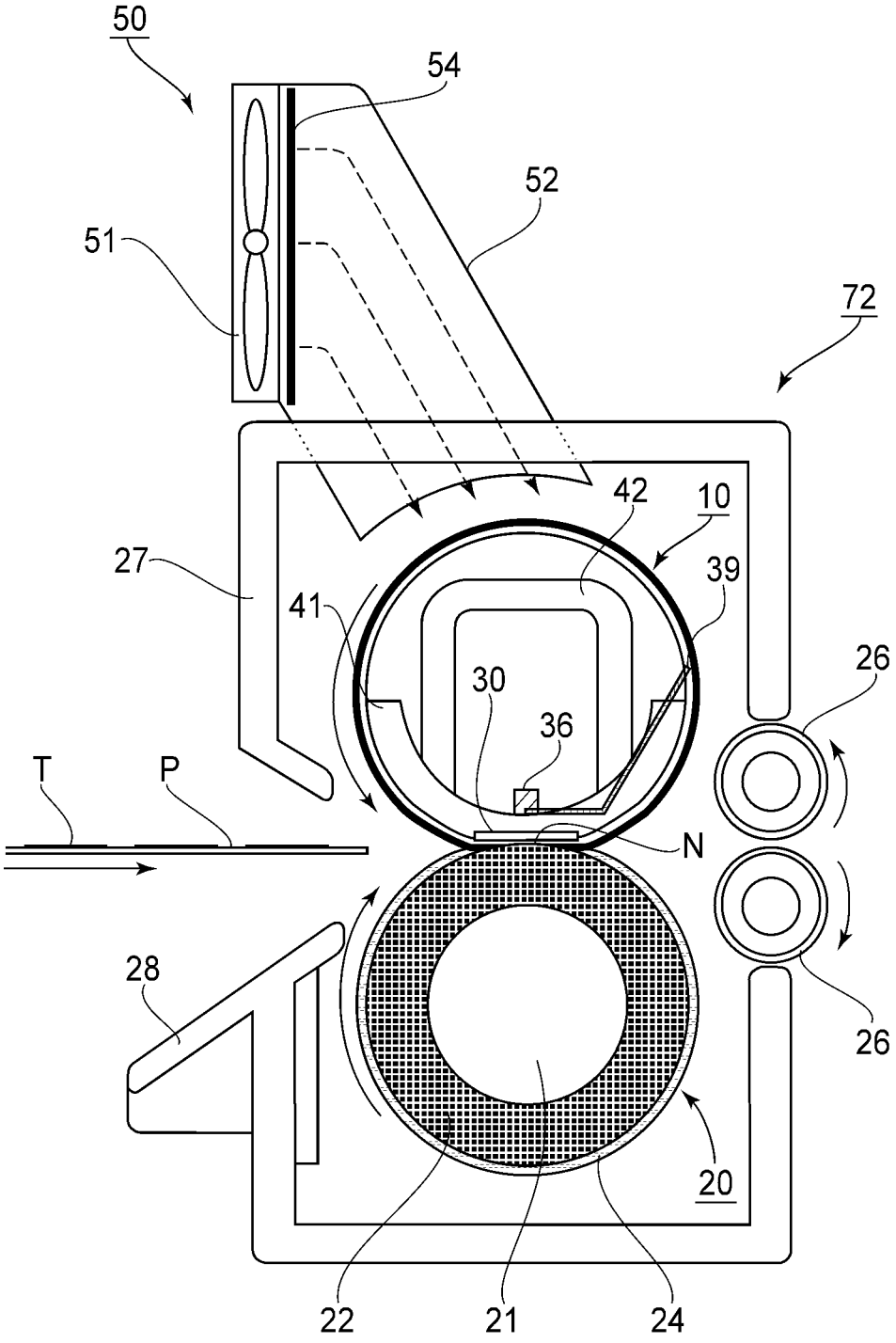
FIG. 3 is a schematic sectional view of the fixing device in the first embodiment of the present invention, as seen from the direction perpendicular to the recording medium conveyance direction.

Referring to FIG. 3, the pressure roller 20 has: a core (shaft) portion 21; a heat resistant elastic layer 22, which is on the outward surface of the core portion 21 and comprises one or more sub-layers; and a parting layer 24, which is on the outward surface of the heat resistant elastic layer 22. The material for the heat resistant elastic layer 22 of the fixing device 72 is desired to be heat resistant and durable enough for the fixing device 72. It is also desired to be elastic (soft) enough for the fixing device 72. More concretely, silicone rubber, fluorinated rubber, or the like readily available heat resistant elastic rubber, can be used as the material for the heat resistant elastic layer 22.

Further, the thickness of the heat resistant elastic layer 22 does not matter, as long as the heat resistant elastic layer 22 is thick enough for the pressure roller 20 to form the nip N. However, it is desired to be in a range of 2-10 mm. The parting layer 24 may be formed by covering the heat resistant elastic layer 22 with a piece of PFA tube, or coating the heat resistant elastic layer 22 with fluorinated rubber, PTFE, PFA, FEP or the like fluoridated resin. The thickness of the parting layer 24 does not matter, as long as it can provide the pressure roller 20 with satisfactory parting properties. However, it is desired to be in a range of 20-100 μm.

Further, the pressure roller 20 may be provided with a primer layer and/or an adhesive layer for adhesiveness and/or electrical conductivity, which is placed between the heat resistant elastic layer 22 and parting layer 24. In this embodiment, the core portion 21 is a metallic core, and is formed of iron. The heat resistant elastic layer 22 is formed of silicone rubber. It is 4 mm in thickness, and 0.35 W/(m·K) in thermal capacity. As for the parting layer 24, it is a piece of PFA tube, and is 50 μm in thickness after being fitted.

Figure 6:
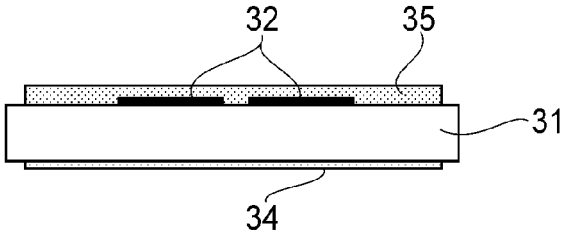
FIGS. 6(*a*) and 6(*b*) are a combination of sectional and plan views of the fixation heater of the fixing device in the first embodiment of the present invention.
Figure 6:
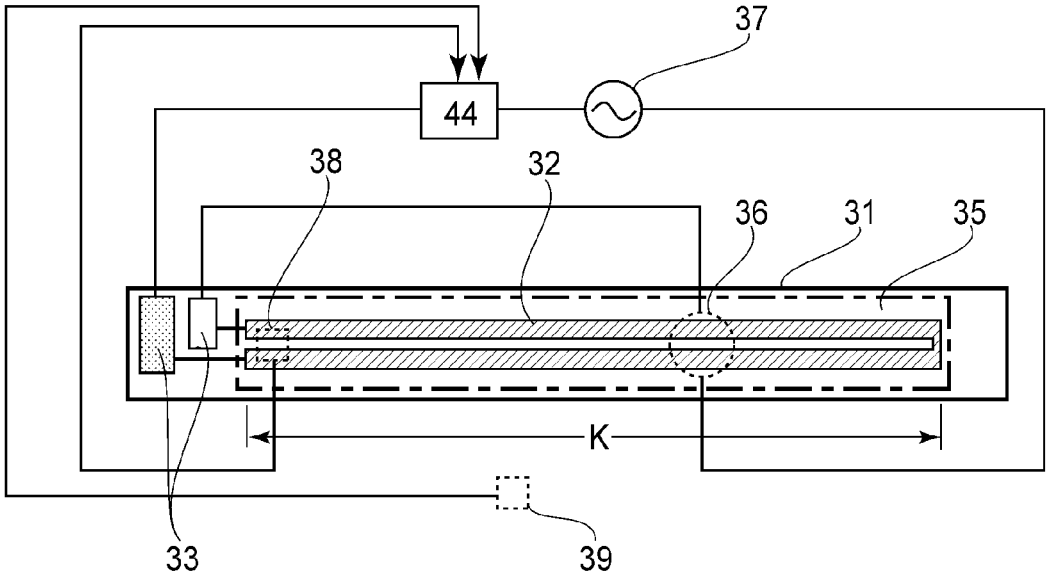

FIGS. 6(*a*) and 6(*b*) is a schematic sectional view of the heater 30 as a heat source. It shows the structure of the heater 30. The heater 30 is a heat generating member which is for quickly heating the fixation sleeve 10 while remaining in contact with the inward surface of the fixation sleeve 10. It has a long and narrow substrative plate (substrative layer) 31, which is disposed so that its long edges become perpendicular to the recording medium conveyance direction. The material for the substrative plate 31 may be alumina, aluminum nitrate, or the like dielectric ceramic, or polyimide, PPS, liquid polymer, or the like heat resistant resin. The back surface (which faces opposite from pressure roller 20) of the substrative plate 31 is provided with a heat generating resistor layer 32, which is formed of Ag/Pd (silver/palladium), $RuO_2$, $TaO_2N$, or the like heat generating resistor, in the pattern of a long and narrow belt, by screen printing or the like coating method.

The heat generating resistor layer 32 is roughly 10 μm in thickness, and 1-5 mm in width. Further, the back surface of the substrative plate 31, more specifically, the inward surface of one of the lengthwise ends of the substrative plate 31, is provided with a power supply electrode 33 for supplying the heat generating resistor layer 32 with electric power. Further, the heater 30 is provided with a glass coat 35, which is formed in a thickness of roughly 30 μm on the back side of the substrative plate 31, in order to ensure that the heat generating resistor layer 32 is protected and electrically insulated. The front surface (which faces pressure roller 20) of the substrative plate 31 is provided with the friction-reducing protective layer 34 for improving the surface properties of the substrative plate 31. The substance used as the material for the friction-reducing protective layer 34 is heat resistant resin, such as polyimide and polyamide-imide, or glass.

The pressure bearing stay 42 is formed of a rigid substance, such as metal, and is U-shaped in cross-section. It is disposed so that its opening faces downward. More specifically, it is disposed on the inward side of the fixation sleeve 10, in such a manner that it is on the top surface (opposite surface from pressure roller 20) of the heater holder 41, being centered in terms of the widthwise direction of the heater holder 41. Its lengthwise end portions are under the pressure applied thereto by a pair of pressuring applying means 43 such as a pair of compression springs, toward the axial line of the pressure roller 20, through a pair of fixation flanges 45 held to the apparatus frame 27.

Thus, the front surface of the substrative plate 31 of the heater 30 is pressed against the pressure roller 20, with the presence of the fixation sleeve 10 between the two surfaces, whereby the elastic layer 22 of the pressure roller 20 is elastically deformed along the substrative plate 31. In other words, the nip (fixation nip) N, which has a preset width necessary to thermally fix the toner image T, is formed between the peripheral surface of the pressure roller 20 and the outward surface of the fixation sleeve 10. The total amount of force (pressure) applied to the pressure roller 20 by the pressure applying means 43 is 294 N (30 kgf).

Figure 4:
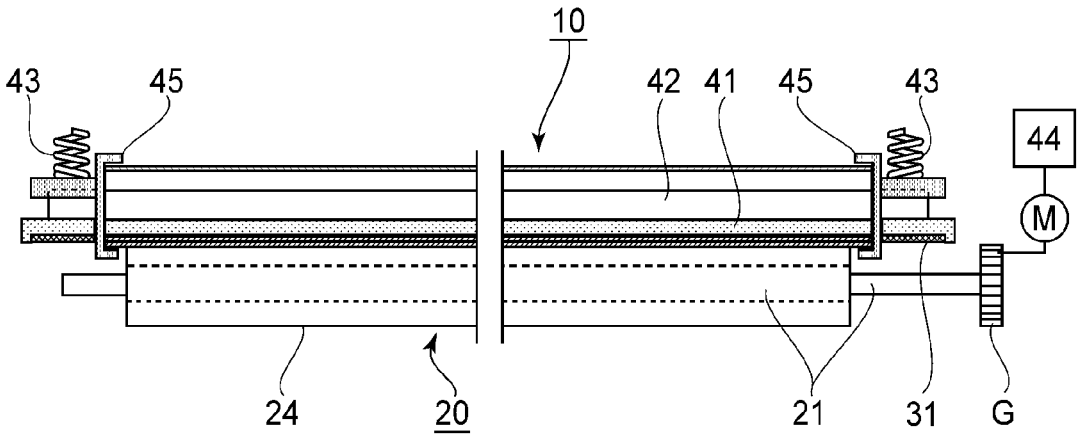
FIG. 4 is a schematic sectional view of the fixing device in the first embodiment of the present invention, as seen from the direction parallel to the recording medium conveyance direction.

Referring to FIG. 4, a control portion 44, as controlling means, carries out a preset control sequence to drive a motor M, as a driving force source, to rotate a driving gear G, with which one of the lengthwise ends of the core (shaft) portion 21 of the pressure roller 20 is provided. Thus, the pressure roller 20 rotates in the direction indicated by an arrow mark (FIG. 3) at a preset peripheral velocity (process speed), while causing the friction generated between the peripheral surface of the pressure roller 20 and the outward surface of the fixation sleeve 10 in the nip N, to generate such rotational force that rotates the fixation sleeve 10 in the opposite direction from the rotational direction of the pressure roller 20.

Thus, the fixation sleeve 10 is circularly rotated around the heater holder 41 by the rotation of the pressure roller 20 in the direction indicated by an arrow mark (FIG. 3) at roughly the same peripheral velocity as the pressure roller 20, with the inward surface of the fixation sleeve 10 remaining in contact with the friction-reducing protective layer 34 of the heater 30.

Referring again to FIGS. 6(*a*) and 6(*b*), the control portion 44 supplies the heat generating resistor layer 32 with the electric power from an electric power source 37 through the electrical power supply electrode 33 of the heater 30, by carrying out a preset temperature control sequence in response to a print command. Consequently, the heat generating resistor layer 32 generates heat, and therefore, the heater 30 quickly increases in temperature to heat the fixation sleeve 10. The temperature of the fixation sleeve 10 is detected by a main thermistor 39, as the temperature detecting first means, which is on the inward side of the fixation sleeve 10. The main thermistor 39 outputs to the control portion 44, signals which indicate the detected temperature of the fixation sleeve 10.

In terms of the lengthwise direction of the heater 30, the main thermistor 39 is disposed in the portion of the nip N, which corresponds to the recording medium passage, and more specifically, the portion of the recording medium passage that a sheet P of the recording medium never fails to pass, regardless of its size. Designated by reference numeral 38 is a subordinate thermistor (sub-thermistor) 38, as the temperature detecting second means, which will be described later along with the operation of a cooling fan.

The control portion 44 takes up the signals outputted from the main thermistor 39, as the temperature detecting element, to indicate the detected temperature of the fixation sleeve 10. Then, the control portion 44 controls, based on the signals, the amount of electrical power to be supplied to the heat generating resistor layer 32, to keep the temperature of the fixation sleeve 10 at a preset target level. That is, the control portion 44 properly controls the duty ratio, the frequency, and the like, of the voltage to be applied to the heat generating resistor layer 32, based on the signals outputted by the main thermistor 39 to indicate the temperature of the fixation sleeve 10, in order to keep the temperature of the fixation sleeve 10 at the preset target level.

Further, there are disposed thermal protectors 36, such as a thermo-switch, a temperature fuse, and the like, on the back surface of the substrative plate 31 of the heater 30. The input terminal (unshown) of the thermal protector 36 is in serial connection to the electric power source 37, and the output terminal (unshown) of the thermal protector 36 is in serial connection to the heat generating resistor layer 32 of the heater 30. Thus, if the heater 30 goes out of control due to a malfunction or the like of the main thermistor 39, the thermal protector 36 detects the abnormal temperature increase of the heater 30, and shuts down the electric power supply to the heat generating resistor layer 32.

As the rotation of the pressure roller 20 and the fixation sleeve 10 become stable, and the temperature of the fixation sleeve 10 reaches the preset target level and become stable at the preset target level, a sheet P of the recording medium bearing an unfixed toner image T is guided toward the nip N along an entrance guide 28, and then, is introduced into the nip N. Then, the sheet P is conveyed through the nip N while remaining pinched between the outward surface of the fixation sleeve 10 and the peripheral surface of the pressure roller 20. While the sheet P is conveyed through the nip N, the sheet P and the unfixed toner image T thereon are subjected to the heat from the fixation sleeve 10, which is being heated by the heater 30, and the internal pressure of the nip N. Consequently, the toner image T is fixed to the surface of the sheet P by the heat and pressure.

After being conveyed through the nip N, the sheet P of the recording medium is separated from the fixation sleeve 10 by the curvature of the fixation sleeve 10, and is discharged from the fixing device 72 by a pair of discharge rollers 26.

Figure 7:
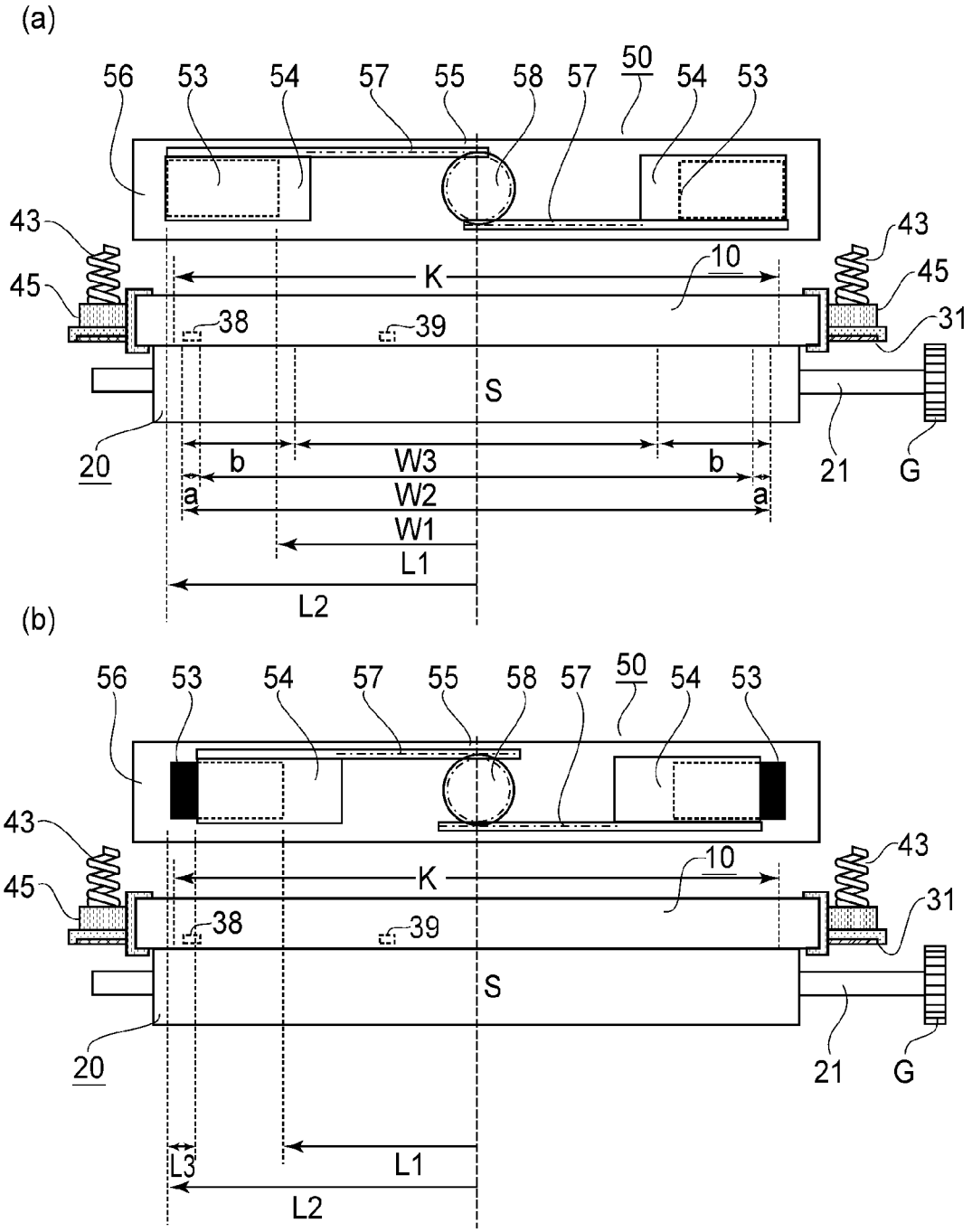
FIGS. 7(*a*) and 7(*b*) are a side view of the fixing device in the first embodiment of the present invention as seen from the recording medium outlet side of the fixing device.
Figure 8:
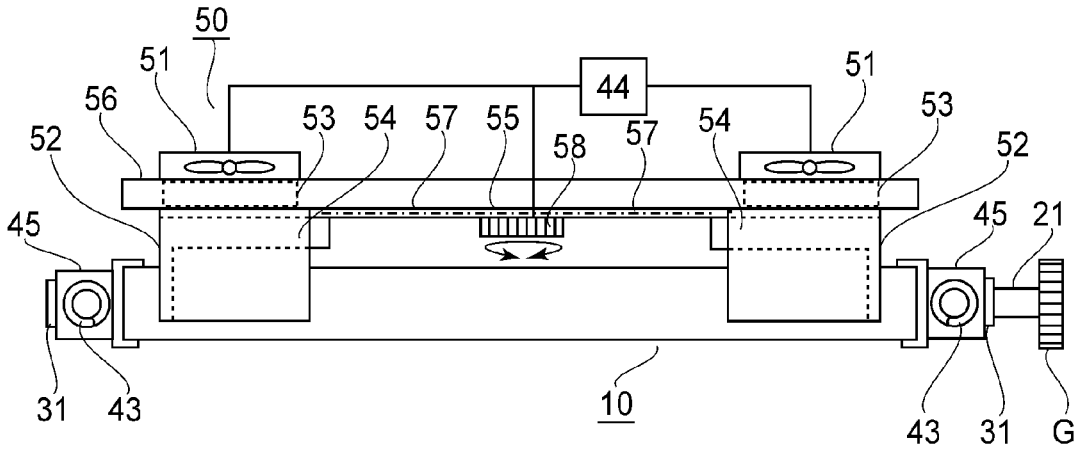
FIGS. 8(*a*) and 8(*b*) are a side view of the fixing device in the embodiment of the present invention as seen from the direction from which the fixation sleeve is cooled.
Figure 8:
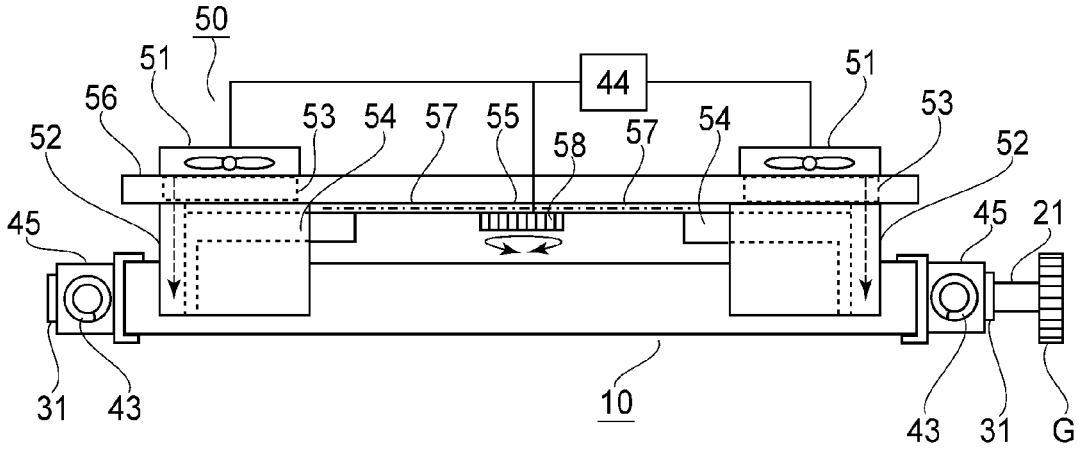

Referring to FIGS. 7 and 8, this image forming apparatus is structured so that when a sheet of the recording medium is conveyed through the apparatus, the center of the sheet in terms of the direction perpendicular to the recording medium conveyance direction coincides with the center (referential line) of the recording medium passage of the apparatus. When a sheet of the recording medium is conveyed through the fixing device, the center of the sheet coincides with the center of the fixation sleeve 10 in terms of the widthwise direction of the fixation sleeve 10. A reference character S stands for the line (theoretical line) which indicates the positional reference line for the recording medium conveyance.

Referring to FIGS. 7(*a*) and 7(*b*), reference characters W1 denote the width (in terms of a direction perpendicular to the recording medium conveyance direction) of the widest sheet of the recording medium conveyable through the apparatus. In the case of the apparatus in this embodiment, the width W1 is 297 mm (size A4 in landscape orientation, A3 in portrait orientation). The width K of the heat generating resistor layer 32 in terms of the lengthwise direction of the heater 30, is slightly greater than the maximum sheet width W1. Reference characters W3 denote the width of the narrowest sheet of the recording medium which is properly conveyable through the fixing device 72. In this embodiment, the width W3 is 148 mm (A5 in portrait orientation). Reference characters W2 denote the width (letter size in landscape orientation, ledger size in portrait orientation) of a sheet of the recording medium, the width of which is between the above mentioned widest and narrowest sheets of recording medium. In this embodiment, it is 279 mm.

Referring to FIGS. 7(*a*) and 7(*b*), a reference character a stands for the difference between the width W1 and the width W2 ((W1−W2)/2). A reference character b denotes for the difference between the width W1 and the width W3 ((W1−W3)/2). That is, they stand for the width of the out-of-sheet-path areas of the fixation nip of the fixing device 72, which occur as a sheet of the recording medium of the LTR size (narrower than sheet of size A4 in landscape orientation) is conveyed in the landscape orientation, or a sheet of the recording medium of the size A5 (narrower than sheet of size A4 in landscape orientation) is conveyed in the portrait orientation. In this embodiment, the fixing device 72 is structured so that when a sheet of the recording medium is conveyed through the fixing device 72, the center of the sheet coincides with the center of the recording medium passage of the fixing device 72. Therefore, the out-of-sheet-path portions a and b occur at the left and right edges of a sheet of the recording medium, which is W2 or W1 in width. The width of these out-of-sheet-path portions varies depending on the width of a sheet of the recording medium used for an image forming operation.

Referring to FIG. 3 and FIGS. 7(*a*) and 7(*b*), a blower portion 50 blows (sends) air to the fixation nip N to prevent the problem that as a substantial number of sheets P of the recording medium which are narrower than the recording medium passage of the fixing device 72 are continuously conveyed through the fixing device 72, the portions of the fixation sleeve 10, which correspond to the output-sheet-path portions of the fixation nip N, excessively increases in temperature. The blower portion 50 has a cooling fan 51, which is an air-blowing member. It also has a duct 52, which guides the air blown by the cooling fan 51, and which has an air outlet (opening) 53 positioned to face the fixing portion. Further, it has: a shutter 54, as an adjusting member, which adjusts the air outlet 53 in size to match the amount of air blown, to the width of a sheet of the recording medium. It has also a shutter driving portion 55, which drives the shutter 54.

The cooling fans 51, the ducts 52, the air outlets 53, and the shutters 54 are symmetrically positioned at the left and right widthwise ends of the fixation sleeve 10, respectively. As for the choice of the cooling fan 51, it may be an axial-flow fan, or a centrifugal fan, such as a sirocco fan. The cooling fan 51 can be changed in air volume (revolution) by the adjustment of the voltage for driving the cooling fan 51. However, the range in which the voltage can be adjusted is limited in order to ensure that the cooling fan 51 properly operates. For example, in a case where an axial-flow fan (24V DC) is employed as the cooling fan 51, the voltage range in which it can be used is 12-24V. That is, as long as this cooling fan 51 is used within this voltage range, it can be assured in terms of air volume. In other words, in the case of this cooling fan 51, it is when 12 V is applied, with the air outlet 53 set to a preset width, that the cooling fan 51 can reliably provide the smallest volume of cooling air.

Referring to FIGS. 7(*a*) and 7(*b*), reference numeral 56 stands for a shutter supporting plate, which extends in the left-right direction and has the pair of air outlets 53. The left and right shutters 54 are slidably supported by the supporting plate 56 so that they can be moved in the left or right direction along the supporting plate 56. The left and right shutters 54 are connected to a combination of a toothed rack 57 and a pinion gear 58. The pinion gear 58 can be rotated forward or in reverse by an unshown motor. Therefore, the left and right shutters 54 can be symmetrically moved to adjust the left and right air outlets 53 in size (width). In other words, the supporting plate 56, the toothed rack 57, the pinion gear 58, and the motor make up a shutter driving device (shutter driving portion) 55.

Referring to FIG. 4, the width of a sheet of the recording medium to be used for image formation is inputted into the control portion 44, based on the information such as the size of a sheet of the recording medium to be used for image formation, which is inputted by a user, or detected by an automatic sheet width detecting portion (unshown) of a sheet feeder cassette. Referring to FIGS. 6(*a*) and 6(*b*), the signals from the sub-thermistor 38, which indicate the temperature of the fixation sleeve 10, are inputted into the control portion 44. Then, the control portion 44 controls the shutter driving portion 55 (FIGS. 7(*a*) and 7(*b*) based on this information. More concretely, it drives the motor to rotate the pinion gear 58 so that the shutters 54 are moved by the toothed racks 57 to open the air outlets 53 by a present amount.

Referring to FIGS. 7(*a*) and 8(*a*), when the cooling fans 51 are not in operation, the air outlets 53 remain completely shut by the shutters 54. On the other hand, as the cooling fans 51 are activated, the shutters 53 are moved by a preset amount by the control portion 44 to open the air outlets 54, as shown in FIGS. 7(*a*) and 8(*a*). Referring to FIG. 7(*a*), reference characters L1 stands for the distance between the reference line S for the positional reference for the recording medium conveyance, and the inward edge of the air outlet 53. Reference characters L2 stands for the distance between the reference line S and the outward edge of the air outlet 53.

When the air outlet 53 is completely covered by the shutter 54, the outward edge of the shutter 54 is at position L2. When the air outlet 53 is fully exposed, the outward edges of the shutter 54 are at a position L1. In this embodiment, L2=161 mm, and L1=85 mm. Further, reference characters L3 in FIG. 7(*b*) stands for the amount by which the air outlet 53 is exposed by the shutter 54, that is, the distance between the outward edge of the air outlet 53 and the outward edge of the shutter 54.

Figure 10:
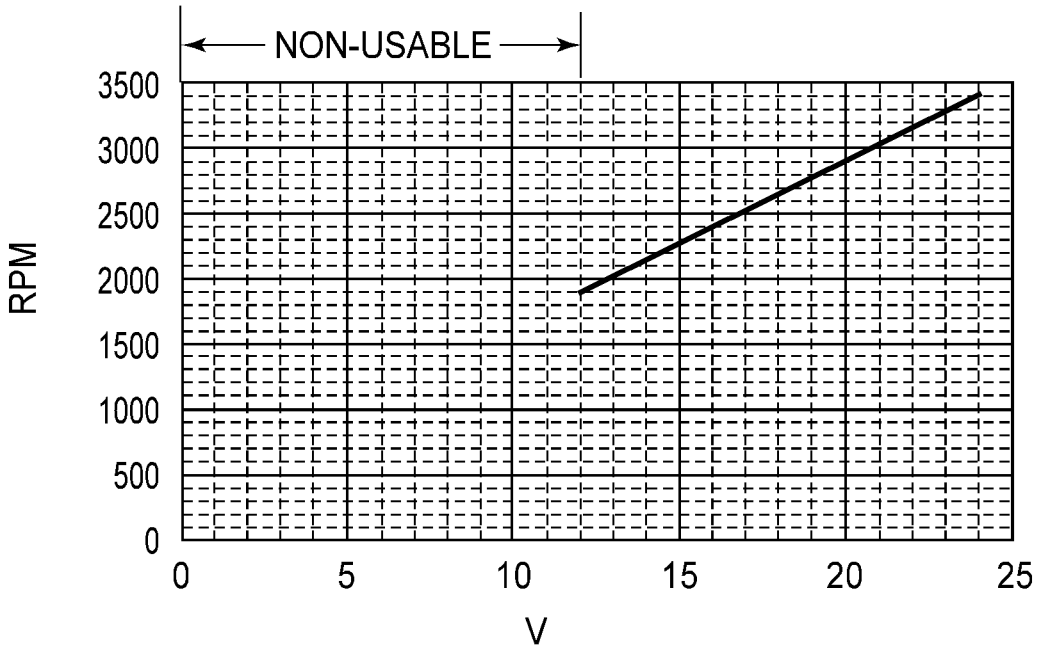
FIG. 10 is a graph which shows the relationship between the voltage applied to drive the cooling fan of the fixing device and the number of revolutions of the cooling fan, in the first embodiment.

The axial-flow fan used as the cooling fan 51 in this embodiment is 80 mm×80 mm×25 mm in external dimensions, and is 12 V-24 V in voltage range (DC). The relationship between the driving voltage (V) and the revolution (rpm) of the cooling fan 51 is as shown in FIG. 10. When the cooling fan 51 is driven by 24 V and 12 V, with no restriction, its capacity is 1.19 $m^3$/min and 0.66 $m^3$/min, respectively. The lowest voltage at which the cooling fans 51 can be driven is 12 V, below which it cannot be reliably driven.

This means that as the cooling fan 51 is driven, cooling air is blown at a rate of at least 0.66 $m^3$/min. The details of the cooling operation, such as the amount L3 by which the shutters 54 are opened during the cooling operation, and the voltage applied to drive the cooling fan 51 during the cooling operation, will be described later.

(Air Blowing Operation)

Next, the air blowing operation in this embodiment is described with reference to a case in which a substantial number of sheets of the recording medium of the letter size are continuously conveyed in the landscape orientation. In this embodiment, the air blowing operation of the cooling fan 51 is controlled based on the temperature of the fixation sleeve 10 detected by the sub-thermistor 38 (FIGS. 7(*a*) and 7(*b*) during the continuous sheet conveyance. In this embodiment, the sub-thermistor 38 is positioned so that it detects the temperature of the out-of-sheet-path portion of the heater 30. Therefore, the maximum value of the surface temperature of the out-of-sheet-path portion of the fixation sleeve 10 can be measured in advance by the sub-thermistor 38.

In this embodiment, twelve levels of cooling are preset as shown in Table 1, and one of these levels is selected to carry out the cooling operation. Table 1 shows the cooling levels for the fixing operation in which letter size sheets of recording medium are conveyed in landscape orientation.

TABLE 1

| | Opening amount | Driving Voltage | Time to level change | |
|---|---|---|---|---|
| | (mm) | (V) | T (sec) | T' (sec) |
| Level 0 | 0 | 0 | 1 | — |
| Level 1 | 4 | 12 | 3 | 3 |
| Level 2 | 4 | 16 | 3 | 3 |
| Level 3 | 4 | 18 | 3 | 3 |
| Level 4 | 4 | 20 | 3 | 3 |
| Level 5 | 4 | 24 | 3 | 3 |
| Level 6 | 8 | 18 | 3 | 3 |
| Level 7 | 8 | 20 | 3 | 3 |
| Level 8 | 8 | 24 | 3 | 3 |
| Level 9 | 12 | 18 | 3 | 3 |
| Level 10 | 12 | 20 | 3 | 3 |
| Level 11 | 12 | 24 | — | 3 |

Here, "cooling level" is the amount by which air is blown by the cooling fan 51. It is determined by the combination of the amount by which the air outlet 53 is exposed by the shutter 54, and the driving voltage of the cooling fan 51. That is, it is the amount by which air is blown at the fixation sleeve 10. "Amount by which air is blown" is the amount of the air blown at the fixation sleeve 10. It is not the total amount by which air can be blown by the cooling fan 51. "Amount of opening" corresponds to the portions of the fixation sleeve 10 at which air is blown by the cooling fan 51. The air blown out of the air outlet 53 goes around the edges of the air outlet 53. Therefore, the portions of the fixation sleeve 10 at which air is blown is wider than the amount by which the air outlet 53 is exposed by the shutter 54. Provided that the driving voltage for the cooling fan 51 remains the same, the greater the amount by which the air outlet 53 is exposed by the shutter 54, the greater the amount of the air which acts on the fixation sleeve 10, for the following reason. That is, the greater the ratio by which the air outlet 53 is covered by the shutter 54, the greater the pressure loss, and therefore, the smaller the amount by which air is blown at the fixation sleeve 10.

As described above, the higher the level of cooling in Table 1, the more effective the cooling portion is in preventing the out-of-sheet-path portions of the fixation sleeve 10. Further, by reducing the amount of exposure of the air outlet 53, the amount of air flowing to the fixation sleeve 10 can be made smaller (like "breeze") than the amount of air flowing to the fixation sleeve 10 when the cooling fan driving voltage is set to the lowest value in the range in which the cooling fan 51 can be reliably operated. In other words, the amount by which cooling air is blown to the fixation sleeve 10 can be controlled not only by the cooling fan driving voltage, but also, the amount by which the air outlet 53 is exposed by the shutter 54. That is, not only is the fixing device 72 in this embodiment wider in the range in which the amount by which air is blown at the fixation sleeve 10, but also, the amount of air blown by the fixing device 72 at the fixing sleeve 10 can be more precisely than any of conventional fixing device in accordance with the prior art.

To sum up, the image forming apparatus in this embodiment can carry out at least the following first and second air blowing operations, when a substantial number of sheets of the recording medium, which are the same in size (width) in terms of the direction perpendicular to the recording medium conveyance direction, are continuously conveyed through the fixing device 72 for fixation. The air blowing first operation is such an operation that the amount by which the air outlet 53 is exposed is set to the first value, and also, the fan revolution is set to the first value. The air blowing second operation is such an air blowing operation that the amount by which the air outlet 53 is exposed is set to the second value, which is greater than the first value, and the fan revolution is set to the second value which is greater than the first value of revolution.

Further, the image forming apparatus can carry out the air blowing third operation in which the air outlet size is set to the third second value and the fan revolution is set to the first value, and also, the air blowing fourth operation in which the air outlet size is set to the first value, and the fan revolution is set to a value which is less than the first value.

Referring to Table 1, when the air outlet size is smallest (not zero), the range in which the cooling fan driving voltage is varied is made largest, whereas when the air outlet size is set to the largest value, the range in which the cooling fan driving voltage is varied is made smaller than the abovementioned largest value. This range includes the cooling fan driving maximum voltage.

Figure 9:
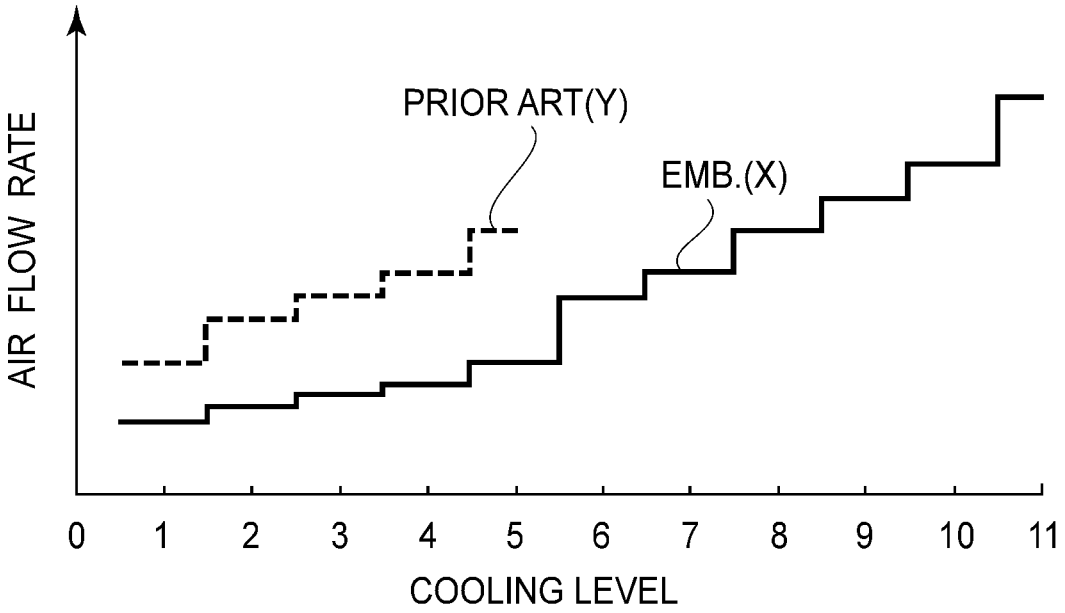
FIG. 9 is a graph which shows the relationship between the level of cooling and the amount by which cooling air is sent by the cooling fan, in the cooling operation carried out by the fixing device in the first embodiment, and that in the comparative cooling operation carried out by the comparative fixing device.

The solid curved line in FIG. 9 schematically shows the relationship between the level of cooling and the amount of cooling air. The higher the level of cooling, the greater the amount of cooling air. When the cooling level is set to zero, the air outlet 53 is completely covered by the shutter 54, and the cooling fan 51 is not operated. When the cooling level is set to the first or higher level, the shutter 54 is moved to expose the air outlet 53, and the cooling fan 51 is activated. In other words, the portion of the air outlet 53, which corresponds in position to the out-of-sheet-path portion of the fixation sleeve 10, is exposed to allow the air blown by the cooling fan 51 to reach only the out-of-sheet-path portion, to reduce the out-of-sheet-path portions in temperature.

Incidentally, although Table 1 shows the relationship between the size L3 of the opening of the air outlet 53 and the cooling fan driving voltage, for every cooling level, when a letter size sheet of the recording medium is conveyed in the landscape orientation, there are tables for other sheets of the recording medium that are different in size from the letter size, which are similar to Table 1, and in which the relationship between the size of the opening of the air outlet 53 and the cooling fan driving voltage is preset for each cooling level.

Figure 1:
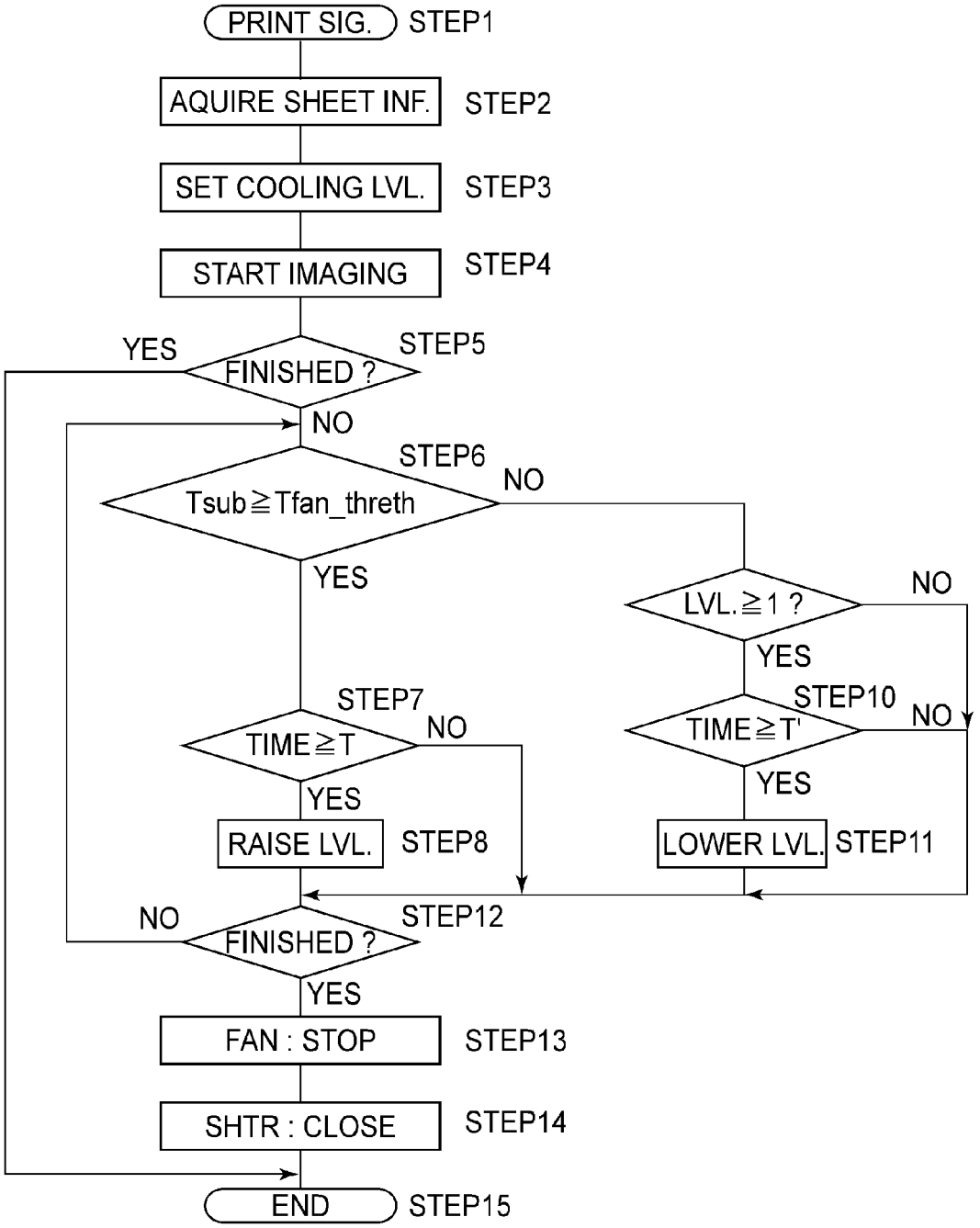
FIG. 1 is a flowchart for the cooling operation to be carried out during an image forming operation, by the fixing device in the first embodiment of the present invention.

Next, referring to FIG. 1, the cooling operation carried out by the image forming apparatus, while being controlled by the control portion 44, to prevent the out-of-sheet-path portions from excessively increasing in temperature when a substantial number of sheets of the recording medium are continuously conveyed through the fixing device 72 is described. As a print signal is received (Step 1), which cooling level is to be used is determined (Step 3), based on the information regarding the sheet of the recording medium to be used for the image formation (Step 2). Then, electric power begins to be supplied to the heater 30, to start warming up the fixing device 72. As the temperature of the fixation sleeve 10 of the fixing device 72 reaches a preset level, the control portion 44 starts the printing operation, and begins to control the fixing device 72 so that the temperature of the fixation sleeve 10 detected by the main thermistor 39 remains at the preset level (fixation temperature, target level (Step 4).

As the printing operation continues (Step 5), the temperature Tsub detected by the sub-thermistor 38 becomes higher than Tfan-threth (Step 6). As the length of time Tsub remained higher than Tfan-threth for a length T of time (Step 7), the control portion 44 raises the cooling level by one level (Step 8), whereby the shutter 54 is moved to a preset position, and the cooling fan 51 is driven by a preset driving voltage. Thus, the out-of-sheet-path portions of the fixation sleeve 10 are cooled by the cooling airflow from the cooling fan 51.

As the printing operation continues (Step 12), and the temperature Tsub detected by the sub-thermistor 38 falls below the Tfan-threth (threshold level) (Step 6), the control portion 44 lowers the cooling level by one level (Step 11) after Tsub remains below Tfan-threth for a length T' of time (Step 10). Thereafter, as the temperature detected by the sub-thermistor 38 again remains higher than Tfan-threth for the length T of time (Step 7), the control portion 44 raises the cooling level by one level (Step 8).

As described above, the control portion 44 changes the cooling level in response to the temperature Tsub detected by the sub-thermistor 38. That is, as the temperature Tsub detected by the sub-thermistor 38 remains higher than the threshold value Tfan-threth for a preset length of time, which is the length T of time in this embodiment, the control portion 44 raises the cooling level by one level, and as Tsub remains below the threshold value Tfan-threth for a preset length (T' in this embodiment) of time, the control portion 44 lowers the cooling level by one level. Here, the threshold temperature Tfan-threth is such a temperature level that the highest temperature level which the out-of-sheet-path portions of the fixation sleeve 10 reaches remains below the highest temperature level at which the fixation sleeve 10 is usable, or such a temperature level above which "hot offset" occurs across the lateral edge portion of a sheet of recording medium.

Referring to FIG. 1, in a case where the printing operation is ended while the cooling fan 51 is driven (Step 12), the control portion 44 stops the cooling fan 51 (Step 13), moves the shutter 54 to the position in which the shutter 54 completely covers the air outlet 53 (Step 14), and ends the printing operation (Step 15).

That is, if the temperature of the out-of-sheet-path portions of the fixation sleeve 10 are lower than the threshold temperature level, the image forming apparatus carries out the air blowing first operation in which the size of the opening of the air outlet 53 is set to the first size, whereas if it is higher than the threshold temperature level, the image forming apparatus carries out the air blowing second operation in which the size of the opening of the air outlet 53 is set to the second size which is larger than the first size.

Further, based on the temperature of the out-of-sheet-path portions of the fixation sleeve 10, the image forming apparatus carries out the air blowing first operation in which the size of the opening of the air outlet 53 is set to the first size, and the fan revolution is set to the first value, or the air blowing second operation in which the size of the opening of the air outlet 53 is set to the second value, which is different from the first value, and the fan revolution is set to the second value which is different from the first value.

As described above, the cooling level is changed in small steps in response to the temperature level detected by the sub-thermistor 38, so that the temperature level detected by the sub-thermistor 38 converges to the adjacencies of the Tfan-threth. Thus, it is possible to minimize the out-of-sheet path portions of the fixation sleeve 10 in temperature fluctuation, and therefore, to keep the output-of-sheet-path portions stable in temperature.

If the control is such that the cooling level is not changed in small steps, and only the cooling fan 51 is turned on or off, the temperature of the out-of-sheet-path portions of the fixation sleeve 10 substantially changes upward or downward, which in turn causes the lateral edge portions of a sheet of the recording medium, which are in the sheet-path portion of the recording medium passage, to substantially change in temperature, and therefore, may cause "hot offset" and/or fixation failure across the lateral edge portions of a sheet of the recording medium. Further, the fixation sleeve 10 may become unstable in its rotation, which affects the recording medium conveyance.

In comparison, in the case of the image forming apparatus (fixing device 72) in this embodiment which is structured as described above, the out-of-sheet-path portions of the fixation sleeve 10 are substantially smaller in temperature fluctuation, being therefore more stable in image and recording medium conveyance than any of conventional fixing devices. In this embodiment, Tfan-threth is set to 215° C. Further, the T and T' may be changed according to each cooling level. In this embodiment, they are set as shown in Table 1.

Figures 14, 15:
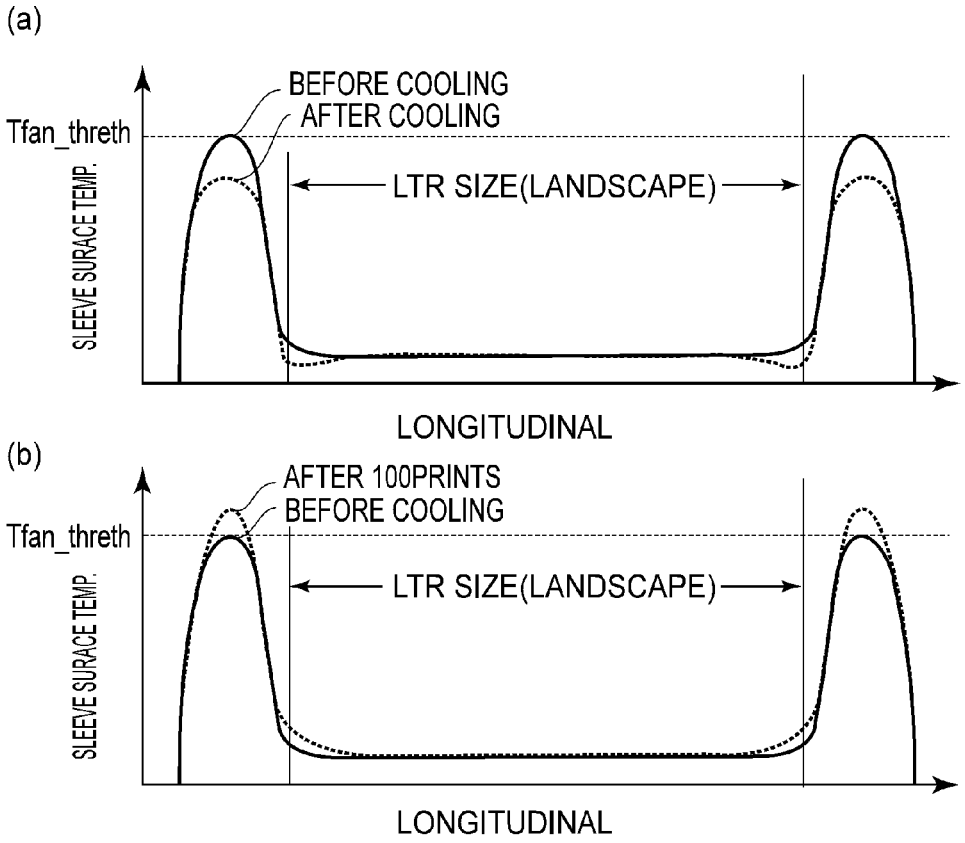
FIGS. 14(*a*) and 14(*b*) are drawings which show the temperature distribution, in terms of the lengthwise direction of the fixation sleeve, of the surface of the fixation sleeve of the comparative fixing device, in the comparative cooling operation.
FIG. 15 is a table which shows the process speed, sheet interval, and fixation temperature level of the fixing device, in the first embodiment, relative to recording medium size.

Next, the process speed, sheet interval, initial size of the opening of the air outlet 53, and target temperature level for the fixing device 72 are shown in FIG. 15, for each of various sheets of the recording medium, in terms of size, which are conveyable through the image forming apparatus (fixing device 72). In a case where sheets of the recording medium which are A4 or letter size are conveyed in the landscape orientation, the apparatus is relatively fast in process speed, and relatively short in sheet interval. Therefore, the target temperature level for the fixing portion has to be set relatively higher, which in turn is likely to exacerbate the unwanted temperature increase of the out-of-sheet-path portions of the fixation sleeve 10. In particular, in the case of a sheet of the recording medium of the LTR size, the out-of-sheet-path portions are wider, being therefore worse in terms of the exacerbation of the unwanted temperature increase, than in the case of a sheet of the recording medium of size A4. Therefore, the cooling fan 51 is activated to cool the out-of-sheet-path portions to maintain the productivity of the apparatus. In the case where a sheet of the recording medium of size A4 or A5 is conveyed in the portrait orientation, the out-of-sheet-path portions are wider, and therefore, the unwanted temperature increase is likely to be exacerbated. Therefore, the process speed is made slower than in the case of a sheet of recording medium of LTR size, and sheet interval is widened to set the target temperature level to a lower value. More specifically, in a case where sheets of the recording medium of size A4 are continuously conveyed in the portrait orientation, the printing operation can be continued up to the 1000th sheet, simply by sending cooling air by the cooling fan 51, whereas in the case where sheets of the recording medium of size A5 are continuously conveyed in the portrait orientation, the image forming operation can be continued up to the 500th sheets. In the case of a sheets of the recording medium which are narrower than a sheet of the recording medium of size A5, the out-of-sheet-path portions are wider. Therefore, the cooling fan 51 is not activated. Instead, the sheet interval is widened according to the temperature of the out-of-sheet-path portions to prevent the out-of-sheet-path portions from unwantedly increasing in temperature. Further, for all types, in terms of size, of sheets of the recording medium (A4 in landscape orientation, LTR in landscape orientation, A4 in portrait orientation, and A5 in portrait orientation), multiple cooling levels are provided by the various combination of the fan revolution and the size for the opening of the air outlet 53. By the way, the narrower a sheet of the recording medium, the greater the number of cooling levels that can be set.

Unlike the cooling operation in this embodiment, in the case of a comparative example of the cooling operation, only the cooling fan driving voltage is changed, that is, the size by which the air outlet 53 is exposed by the shutter 54 is not changed, during a continuous printing operation. In the case of this comparative example of the cooling operation, six levels of cooling, which are differentiated by the driving voltage for the cooling fan 51, are provided. Table 2 shows the cooling levels for the comparative example of cooling operation in which sheets of recording medium of letter size are continuously conveyed for fixation.

TABLE 2

| | Opening amount | Driving Voltage | Time to level change | |
|---|---|---|---|---|
| | (mm) | (V) | T (sec) | T' (sec) |
| Level 0 | 0 | 0 | 1 | — |
| Level 1 | 8 | 12 | 3 | 3 |
| Level 2 | 8 | 16 | 3 | 3 |
| Level 3 | 8 | 18 | 3 | 3 |
| Level 4 | 8 | 20 | 3 | 3 |
| Level 5 | 8 | 24 | 3 | — |

For the purpose of squarely comparing this example of the cooling operation with the above-described cooling operation in this embodiment, the details of which are shown in Table 1, Table 2 is also for the cooling operation in which sheets of the recording medium of a letter size are conveyed in the landscape orientation. Referring to FIG. 9, the curved dotted line schematically indicates the relationship between the cooling levels and the amount of cooling air from the cooling fan 51, in the comparative cooling operation. In the case of the comparative cooling operation, the size of the opening of the air outlet 53 is preset (fixed), and the amount by which cooling air is sent is controlled with the use of only the cooling fan 51. Therefore, the top and bottom limits of the amount by which cooling air is sent is determined by the amount of the cooling fan driving voltage. In this case, therefore, the size of the opening of the air outlet 53 has to be set in balance in consideration of the changes in the temperature of the image heating apparatus, which occur as a substantial number of sheets of the recording medium are continuously conveyed through the heating device.

That is, the size of the opening of the air outlet 53 has to be set so that not only the fixation sleeve 10 is not over-cooled during the front half of a continuous printing operation, that is, when the amount of the heat stored in the fixation sleeve 10 is small, but also, the fixation sleeve 10 is not under-cooled even during the latter half of the continuous printing operation, that is, when the amount of the heat stored in the fixation sleeve 10 is substantial. However, in a case where the opening of the air outlet 53 is fixed in size as in the comparative cooling operation, it is only by the cooling fan driving voltage that the amount of cooling air flowing to the fixation sleeve 10 can be controlled. Therefore, the range in which the amount of airflow can be controlled is narrower than that in the above-described embodiment of the present invention.

Incidentally, even in the case of the comparative cooling operation, the cooling fan 51 is controlled based on the temperature Tsub detected by the sub-thermistor 38, and also, the method for switching the cooling portion in cooling level is similar to the one in the first embodiment. Further, the comparative cooling operation carried out when a substantial number of sheets of the recording medium are continuously conveyed is also the same as that in this embodiment.

In order to evaluate the cooling operation in this embodiment in performance, the cooling operation in this embodiment was compared with the comparative cooling operation with the use of the above-described printer 71. In order to compare the two cooling operations under the condition in which the temperature increase of the out-of-sheet-path portions of the fixation sleeve 10 is severe, 100 sheets of the recording medium of letter size (90 g/m$^2$ in basis weight) were continuously conveyed in landscape orientation at a range of 45 sheets/min, in an ambience low in temperature as well as humidity (15° C./10%), and the highest temperature level of the fixation sleeve 10 was measured. The printing operation was started when the temperature of various components of the image heating apparatus were the same (cold) as the ambient temperature.

Figure 13:
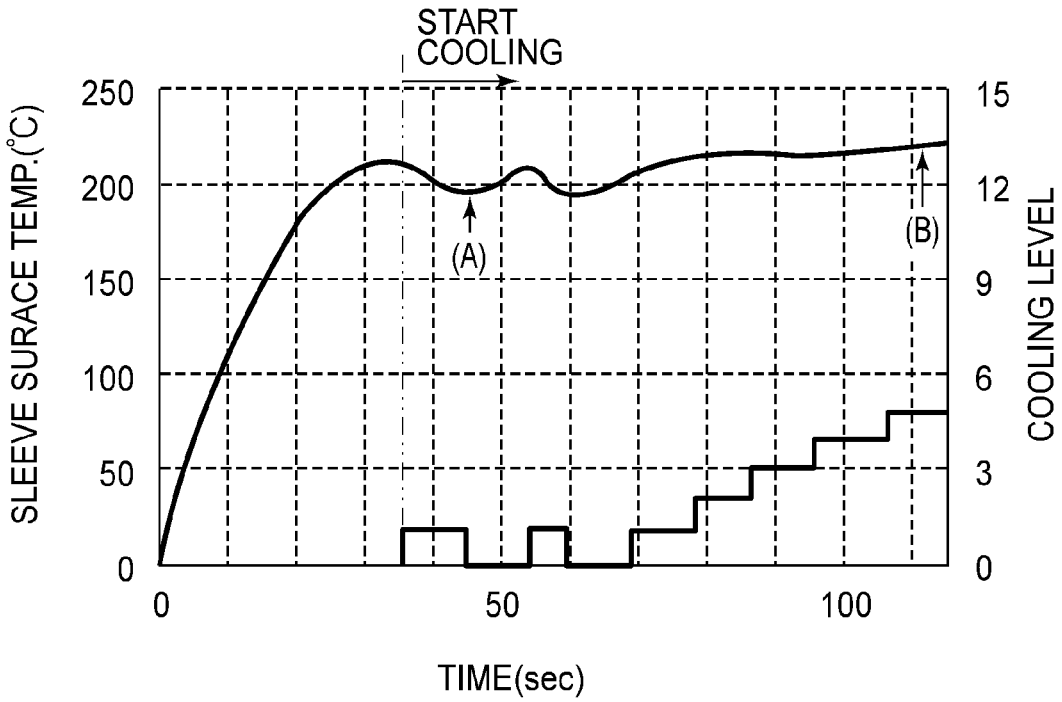
FIG. 13 is a drawing which shows the chronological changes in the highest value of the surface temperature of the out-of-sheet-path portions of the fixation sleeve, and the switching made in the performance (cooling level) to the comparative fixing device, in the comparative cooling operation.

FIG. 13 shows the highest value of the surface temperature of the out-of-sheet-path portions of the fixation sleeve 10, in the comparative cooling operation, and chronological changes in the cooling level, in the comparative cooling operation. FIG. 14 shows the temperature distribution of the fixation sleeve surface at points (A) and (B) in FIG. 13. Referring to FIG. 13, which is related to the comparative cooling operation, the cooling operation is started at a point (A) which is immediately after the starting of the cooling operation, with the cooling level set to level 1, which is the smallest in the amount by which air is sent. Yet, the fixation sleeve temperature substantially dropped. At the same time, the temperature of the edge portions of the out-of-sheet-path portions of the fixation sleeve 10 also substantially dropped, as shown in FIG. 14(*a*). Consequently, fixation failure occurred to the lateral edge portions of a sheet of the recording medium.

The reason for the occurrence of the abovementioned fixation failure is as follows: Immediately after the starting of the cooling operation, the amount of heat stored in each of various components of the image heating device was relatively small, and therefore, the temperature of the fixation sleeve 10 excessively decreased even though the amount of cooling air to be sent was set to the minimum value. Thus, the size by which the air outlet 53 is exposed by the shutter 54 has to be set so that even when the amount of heat stored by the image heating device is relatively small, it does not occur that the fixation sleeve 10 is excessively cooled. Doing so, however, makes insufficient the amount of cooling air sent, after the amount of heat stored by the image heating device increases.

Next, referring to FIG. 13, at a point (B) which is immediately after the printing of the 75th print, the cooling level was set to the level 5, which is the largest in the amount of cooling air sent. However, the fixation sleeve temperature had greatly increased. At the same time, the temperature of the out-of-sheet-path portions of the fixation sleeve 10 had also greatly increased, as shown in FIG. 14(*b*), causing thereby "hot offset" across the lateral edge portions of a sheet of the recording medium. The reason for the occurrence of this "hot offset" is that immediately after the printing of the 75th print, the amount of heat which each of various structural components of the image heating device had accumulated was substantial, and therefore, even though cooling air was sent by the maximum amount, the fixation sleeve 10 increased in temperature. If the size by which the air outlet 53 is to be exposed by the shutter 54 is optimally set to deal with this temperature increase, which occurs only when the amount of heat stored by the image heating device is large, the above-described temperature drop, which occurs when the amount of heat stored by the image heating device is small, becomes excessive.

As described above, in the case of the comparative cooling operation, the size by which the air outlet 53 is exposed by the shutter 54 is fixed. Therefore, the range in which cooling air can be sent by a proper amount is too narrow, that is, insufficient either to keep the image heating device satisfactory in heating performance (fixing performance), or to prevent the unwanted temperature increase of the out-of-sheet-path portions. That is, the comparative cooling operation possibly cannot stabilize the image heating device in performance in terms of the heating of the lateral edge portions of a sheet of the recording medium and/or cannot satisfactorily prevent the unwanted temperature increase of the out-of-sheet-path portions, when the amount of heat stored by the image heating device is very small and also, very large.

Figure 11:
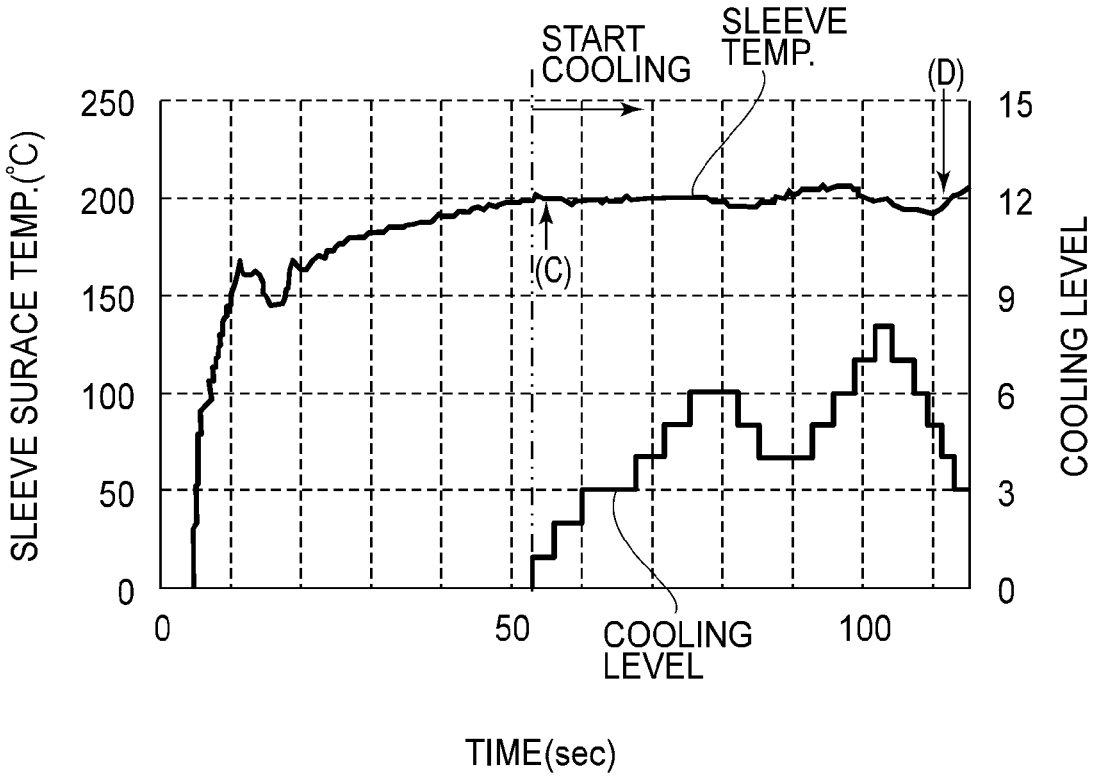
FIG. 11 is a graph which shows the highest value of the surface temperature of the out-of-sheet-path portions of the fixation sleeve of the fixing device in the first embodiment, and the chronological switching made to the fixing device in cooling performance (cooling level).
Figure 12:
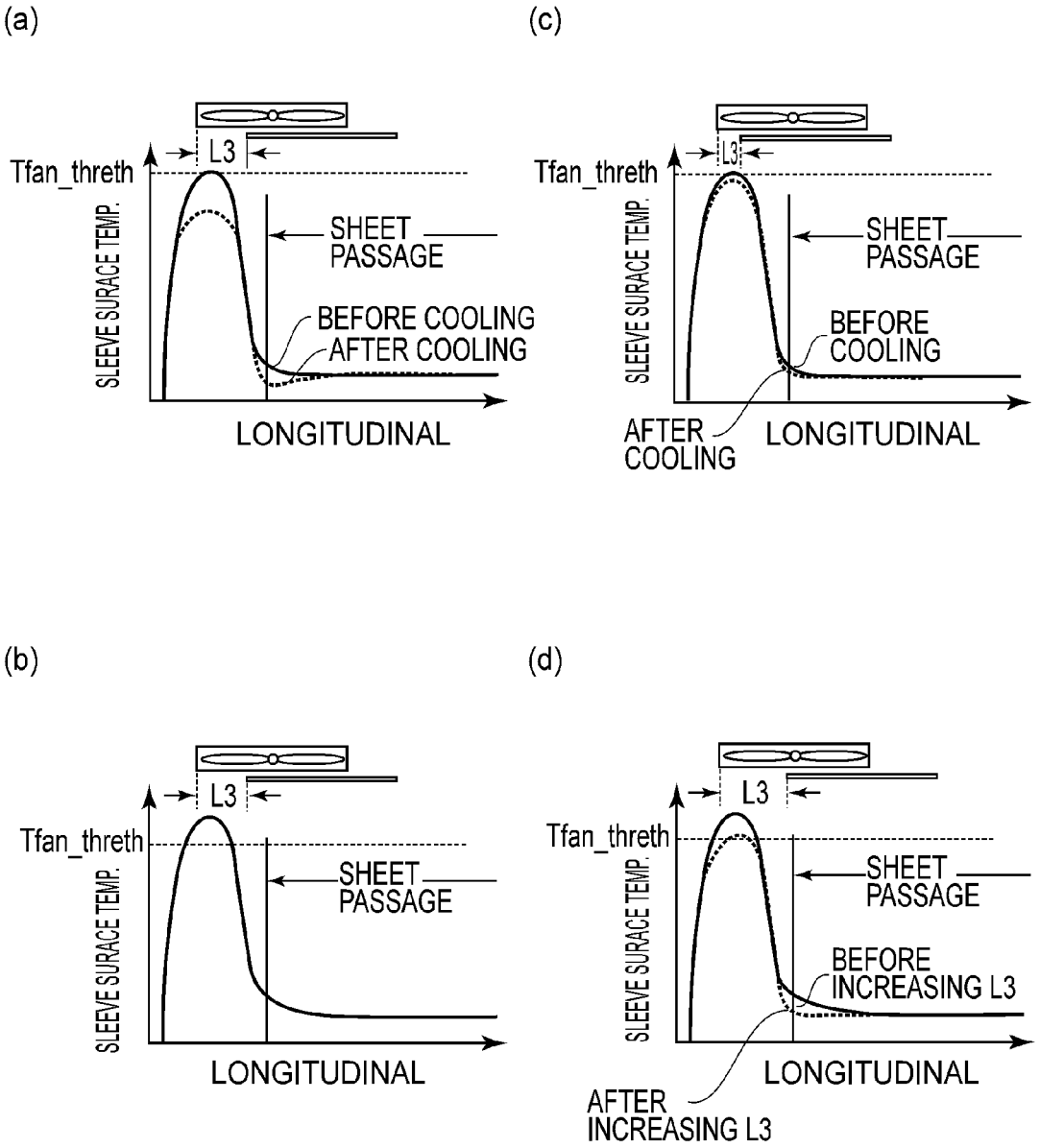
FIGS. 12(*a*)-12(*d*) show the relationships between the temperature distributions of the outward surface of the fixation sleeve and the amounts.

In comparison, the results of the evaluation of the cooling operation in this embodiment are described. Shown in FIG. 11 are the highest value of the surface temperature of the out-of-sheet-path portions of the fixation sleeve 10, and the chronological changes made in cooling level. FIGS. 12(*a*)-12(*d*) show the relationship between the temperature distribution of the fixation sleeve surface in terms of the widthwise direction of the fixation sleeve 10, and the size by which the air outlet 53 was exposed by the shutter 54, at points (A) and (B) in FIG. 13, and points (C) and (D) in FIG. 11.

In this embodiment, at a point (C) in FIG. 11, which is immediately after the starting of the cooling operation, in the case of the cooling operation in this embodiment, the temperature of the fixation sleeve 10 did not substantially drop, and the temperature of the fixation sleeve 10 remained stable at roughly Tfan-threth, unlike in the case of the comparative cooling operation. Further, the portions of the fixation sleeve 10 that are adjacent to the sheet-path portion of the sheet passage did not substantially drop, as shown in FIG. 12(*c*), and fixation failure did not occur. This result is attributable to the fact that, in the case of the cooling operation in this embodiment, the size L3 was set smaller when the cooling fan driving voltage was lowest, as shown in FIG. 12(*c*), in order to prevent the temperature drop which occurred to the portions of the fixation sleeve 10, which are adjacent to the sheet-path portions of the sheet passage, as shown in FIG. 12(*a*). Therefore, it was possible to carry out the cooling operation without drastically reducing the temperature of the sheet-path portions of the fixation sleeve 10, and therefore, to prevent the fixation failure which was likely to occur across the lateral edge portions of the sheet path portion.

Also in this embodiment, at a point (D) in FIG. 11, which is immediately after the completion of the 75th print, the temperature of the fixation sleeve 10 had not substantially increased, remaining stable at roughly 200° C. Also at this point, the temperature of the lateral edge portions of the sheet-path portion of the fixation sleeve 10 had not substantially increased as shown in FIG. 12(*d*). Therefore, it was possible to prevent the "hot offset". The reason for these results is that in this embodiment, in order to prevent the temperature increase of the lateral edge portions of the sheet-path portions of the fixation sleeve 10, which occurred in the case of the comparative cooling operation as shown in FIG. 12(*b*), the cooling fan driving voltage was set to highest value, and the size L3 of the opening of the air outlet 53 was increased as shown in FIG. 12(*d*). Therefore, it was possible to control the cooling operation without drastically increasing the temperature of the lateral edge portions of the sheet-path portion of the fixation sleeve 10, and therefore, to prevent the "hot offset" of the lateral edge portions of the sheet-path portions.

As described above, in this embodiment, the cooling level is set by the combination of the cooling fan driving voltage, and the size of the opening of the air outlet 53, which is controlled by the shutter 54. Therefore, it is possible to widen the range in which the amount of cooling air can be properly set. Further, it becomes possible to minimize the temperature fluctuation that occurs to the out-of-sheet-path portions of the fixation sleeve 10 when a substantial number of sheets of the recording medium, which are the same in size, are continuously conveyed through the fixing device 72. That is, it becomes possible to keep the fixation sleeve 10 stable in temperature roughly at the target level, across the sheet-path portions as well as the out-of-sheet-path portions.

Next, the fixing device in another embodiment of the present invention is described. The fixing device in this embodiment is the same in basic structure and operation as the fixing device in the first embodiment. It is provided with an additional operational mode different from those of the fixing device in the first embodiment, as well as those of the fixing device in the first embodiment. More concretely, it is provided with such an operational mode that as the temperature Tsub detected by the sub-thermistor 38 remains higher than Tfan-skip (=Tfan-threth+5° C.) for one second, the cooling portion is increased, that is, raised in performance, by multiple levels, for example, 5 levels, whereas as the temperature Tsub detected by the sub-thermistor 38 remains lower than the temperature level Tfan-off (=Tfan-threth−10° C.), the cooling performance is lowered to zero; driving of the cooling fan 51 is stopped.

In the first embodiment, it is always by one level that the cooling fan 51 is switched in performance (cooling level). That is, even if the temperature detected by the sub-thermistor 38 suddenly changes, it is only by one cooling level that the cooling fan 51 can changed in performance. Thus, if the out-of-sheet-path portions of the fixation sleeve 10 suddenly increase in temperature, the operation for switching the performance of the cooling fan 51 in cooling level to the optimal level cannot keep up with the sudden change. Therefore, it is possible that the temperature of the out-of-sheet-path portions will become extremely high. On the other hand, if the sheet-path portion of the fixation sleeve 10 is suddenly reduced in temperature by the driving of the cooling fan 51, the cooling portion cannot be quickly reduced in performance. Thus, it is possible that the fixation sleeve 10 will be excessively cooled, and therefore, the fixation failure will occur.

In this embodiment, however, if it is detected that the current cooling level cannot keep the temperature detected by the sub-thermistor 38, in the adjacencies of the threshold value (level: Tfan-threth+5° C.--10° C.), the cooling portion can be substantially reduced in performance (cooling level). Therefore, the temperature detected by the sub-thermistor 38 can be made to converge to the adjacencies of the threshold temperature Tfan-threth to stabilize the out-of-sheet-path portions in temperature.

For example, if an image forming operation is switched in the recording medium to sheets of cardstock, which are 160 g/m$^2$ in basis weight, while sheets of ordinary paper, which are 75 g/m$^2$ in basis weight are continuously conveyed, or in the like situation, it is possible that the out-of-sheet-path portions of the fixation sleeve 10 will suddenly increase in temperature. In the case of the cooling operation in this embodiment, which is configured as described above, however, the cooling portion can be quickly switched in performance (cooling level), and therefore, can prevent the out-of-sheet-path portions from suddenly increasing in temperature. On the other hand, if an image forming operation is switched in the recording medium to sheets of thin paper while sheets of cardstock are continuously conveyed, the cooling portion can be controlled so that the fixation sleeve 10 will not be excessively cooled.

In the foregoing, the present invention was described with reference to the embodiments of the present invention. However, these embodiments are not intended to limit the present invention in scope. That is, these embodiments are variously modifiable within the scope of the present invention.

(Modification 1)

In the preceding embodiments, the printer 71 was structured so that in terms of the lengthwise direction of its fixing device (fixation sleeve), a sheet of the recording medium is positioned so that its center line coincides with the center line of the recording medium conveyance passage of the fixing device. However, the present invention is also applicable to printers structured so that a sheet of the recording medium is positioned so that one of two edges of the sheet of the recording medium is placed in contact with the corresponding edge of the sheet conveyance passage of the fixing device.

Also in the preceding embodiments, the pressure applying member of the fixing device was the pressure roller. However, the present invention is also compatible with fixing devices, the pressure applying member of which is a stationary pressure pad.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Applications Nos. 093609/2013 and 060012/2014 filed Apr. 26, 2013 and Mar. 24, 2014, respectively, which are hereby incorporated by reference.

What is claimed is:

1. An image forming apparatus for forming a toner image on a recording material, said image forming apparatus comprising:

an image forming portion configured to form an unfixed toner image on the recording material;

a fixing portion, including a heating member and a back-up member configured to cooperate with said heating member to form a nip, configured to fix the unfixed toner image on the recording material by heating the recording material bearing the unfixed toner image in the nip while feeding recording material;

an air feeding portion configured to feed air to a non-sheet-passing area of at least one of said heating member and said back-up member, said air feeding portion including a fan configured to feed the air, an opening through which the air fed from said fan passes, and an adjusting member configured to adjust an opening amount of said opening; and a temperature detecting member configured to detect a temperature of the non-sheet-passing area, wherein said apparatus is configured to switch, when said fixing portion fixes the unfixed toner images on recording materials having the same widths measured in a direction perpendicular to a feeding direction of the recording materials, between a first air feeding operation with a first opening amount of said opening and a second air feeding operation with a second opening amount of said opening different from the first opening amount, according to the temperature detected by said temperature detecting member.

2. The apparatus according to claim 1, wherein said apparatus is configured to execute the first air feeding operation and the second air feeding operation when said fixing portion fixes the unfixed images on the same kinds of recording materials.

3. The apparatus according to claim 1, wherein said apparatus switches between the first air feeding operation and the second air feeding operation while said fan is feeding the air.

4. The apparatus according to claim 1, wherein said apparatus switches between the first air feeding operation and the second air feeding operation in a period of cooling the non-sheet-passing area by the air fed from said fan.

5. The apparatus according to claim 1, wherein a rotational frequency of said fan in the first air feeding operation is different from the rotational frequency of said fan in the second air feeding operation.

6. The apparatus according to claim 5, wherein the second opening amount of said opening is larger than the first opening amount of said opening, and the rotational frequency in the second air feeding operation is higher than the rotational frequency in the first air feeding operation.

7. The apparatus according to claim 6, wherein said apparatus is configured to execute a third air feeding operation with the second opening amount of said opening and the rotational frequency of said fan equal to the rotational frequency in the first air feeding operation.

8. The apparatus according to claim 6, wherein said apparatus is configured to execute a fourth air feeding operation with the first opening amount of said opening and the rotational frequency of said fan lower than the rotational frequency in the first air feeding operation.

9. The apparatus according to claim 5, wherein the second opening amount is larger than the first opening amount, and the rotational frequency in the second air feeding operation is lower than the rotational frequency in the first air feeding operation.

10. The apparatus according to claim 1, wherein the first opening amount is set in response to the width of the recording material.

11. The apparatus according to claim 1, wherein said adjusting member is movable to close a part or all of said opening.

12. The apparatus according to claim 1, wherein said heating member includes a cylindrical film and a nip forming member contacting an inner surface of said film to form the nip with said back-up member via said film.

13. The apparatus according to claim 12, wherein said nip forming member includes a heater.

14. The apparatus according to claim 1, wherein the second opening amount of said opening is larger than the first opening amount of said opening, and wherein said apparatus switches from the first air feeding operation to the second air feeding operation in the case that the temperature detected by said temperature detecting member has been higher than a threshold temperature for a predetermined time period.

15. The apparatus according to claim 1, wherein the second opening amount of said opening is smaller than the first opening amount of said opening, and wherein said apparatus switches from the first air feeding operation to the second air feeding operation in the case that the temperature detected by said temperature detecting member has been lower than a threshold temperature for a predetermined time period.

* * * * *